US006263671B1

(12) United States Patent
Bliesner

(10) Patent No.: US 6,263,671 B1
(45) **Date of Patent: *Jul. 24, 2001**

(54) HIGH EFFICIENCY DUAL SHELL STIRLING ENGINE

(76) Inventor: Wayne T Bliesner, 2251 138th Ave. SE., Snohomish, WA (US) 98296

( * ) Notice: Subject to any disclaimer, the term of this patent is extended or adjusted under 35 U.S.C. 154(b) by 0 days.

This patent is subject to a terminal disclaimer.

(21) Appl. No.: 09/500,185

(22) Filed: Feb. 7, 2000

Related U.S. Application Data

(63) Continuation-in-part of application No. 08/971,235, filed on Nov. 15, 1997, now Pat. No. 6,041,598.

(51) Int. Cl.[7] ..... F01B 29/10
(52) U.S. Cl. ..... 60/517; 60/526
(58) Field of Search ..... 60/517, 526; 220/426, 220/429; 165/104.19, 104.21, 135, 136, DIG. 342, DIG. 348

(56) References Cited

U.S. PATENT DOCUMENTS

| | | | | |
|---|---|---|---|---|
| 3,949,554 | | 4/1976 | Noble et al. . | |
| 3,991,457 | * | 11/1976 | Barton | 60/524 X |
| 4,055,951 | * | 11/1977 | Davoud et al. | 60/514 |
| 4,174,616 | | 11/1979 | Nederlof et al. . | |
| 4,214,447 | * | 7/1980 | Barton | 60/525 |
| 4,235,116 | * | 11/1980 | Meijer et al. | 74/60 |
| 4,405,010 | | 9/1983 | Schwartz . | |
| 4,425,764 | | 1/1984 | Lam . | |
| 4,429,732 | | 2/1984 | Moscrip . | |
| 4,472,679 | | 9/1984 | Inoda et al. . | |
| 4,607,424 | | 8/1986 | Johnson . | |
| 4,625,514 | * | 12/1986 | Tanaka et al. | 60/517 |
| 4,662,176 | | 5/1987 | Fujiwara et al. . | |
| 4,723,410 | | 2/1988 | Otters . | |
| 4,799,421 | | 1/1989 | Bremer et al. . | |
| 4,815,290 | | 3/1989 | Dunstan . | |
| 4,832,118 | | 5/1989 | Scanlon et al. . | |
| 4,869,212 | * | 9/1989 | Sverdin | 123/56 BC |
| 4,894,989 | | 1/1990 | Mizuno et al. . | |
| 5,074,114 | | 12/1991 | Meijer et al. . | |
| 5,140,905 | | 8/1992 | Phar . | |
| 5,217,681 | | 6/1993 | Wedellsborg et al. . | |
| 5,242,015 | | 9/1993 | Saperstein et al. . | |
| 5,339,653 | | 8/1994 | Degregoria . | |
| 5,355,679 | | 10/1994 | Pierce . | |
| 5,383,334 | | 1/1995 | Kaminishizono et al. . | |
| 5,388,410 | | 2/1995 | Momose et al. . | |
| 5,429,177 | | 7/1995 | Yaron et al. . | |
| 5,433,078 | | 7/1995 | Shin . | |
| 5,555,729 | | 9/1996 | Momose et al. . | |
| 5,611,201 | | 3/1997 | Houtman . | |
| 5,715,683 | | 2/1998 | Hofbauer et al. . | |
| 6,041,598 | * | 3/2000 | Bliesner | 60/517 |

FOREIGN PATENT DOCUMENTS

| | | |
|---|---|---|
| 2519869 | 11/1976 | (DE) . |
| WO 82/00320 | 2/1982 | (WO) . |

* cited by examiner

*Primary Examiner*—Hoang Nguyen
(74) *Attorney, Agent, or Firm*—Dowrey & Associates

(57) ABSTRACT

A Stirling engine which uses a dual pressure shell surrounding the high pressure and temperature engine components. Space between the shells is filled with an incompressible and insulating liquid material, such as a liquid salt. The liquid may have a filler material to prevent excessive movement. The liquid provides a time varying pressure field, driven by the pressure variations in the Stirling engine working fluid, which cancels the pressure differential on heat transfer tubing. The heat transfer tubing is inside of a dome which contains an incompressible, highly thermally conductive liquid, such as Sodium. The heat transfer tubing uses smaller diameter passages contained within a larger diameter body to reduce manufacturing cost and increase reliability. An annular regenerator offers improved efficiency and power levels. A throttling system vents working fluid to a low-pressure container and maintains engine efficiency. A dual chamber shaft seal prevents the escape of primary working fluid, significantly enhancing the practicality of the engine. A wobble plate attached to the crankshaft controls the displacer piston. A continuous heat extraction burner reduces flame temperature and nitrous oxide emissions from the burner. The combination described provides a Stirling engine that operates at significantly higher temperatures and pressures relative to existing technology.

36 Claims, 12 Drawing Sheets

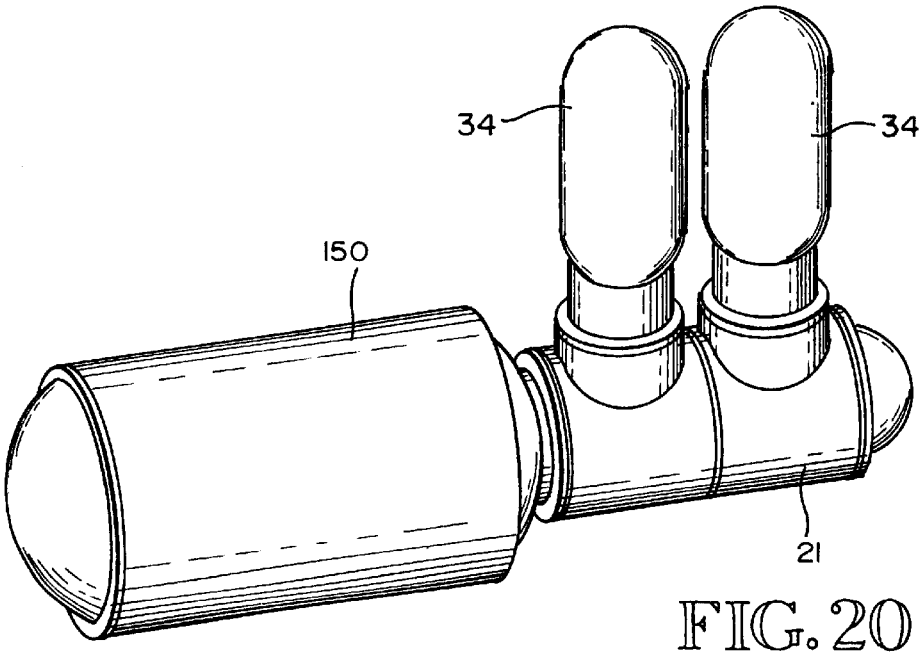
FIG. 20
FIG. 21
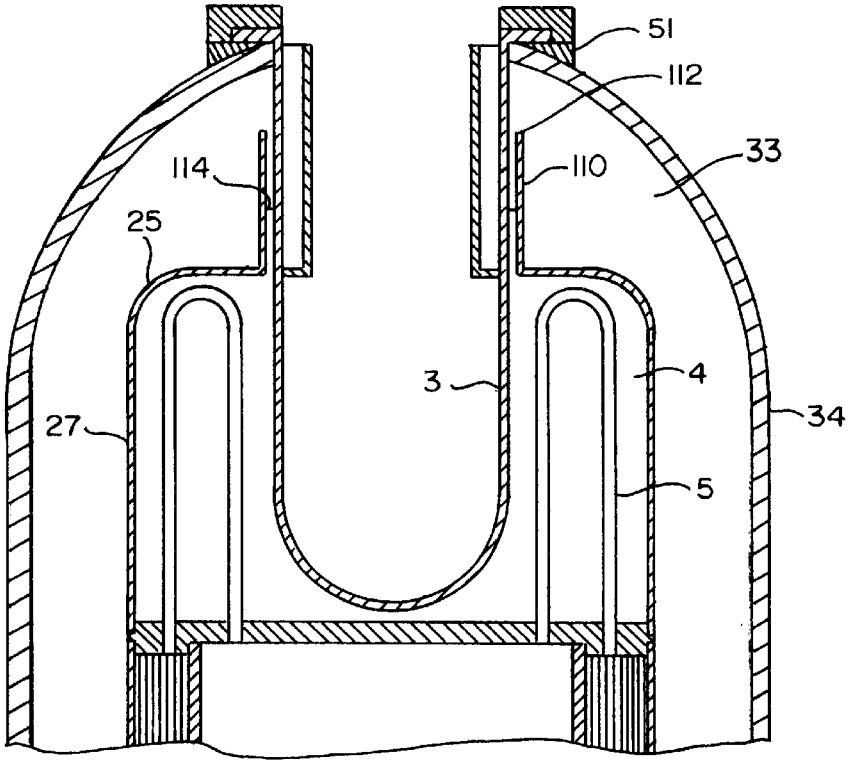

HIGH EFFICIENCY DUAL SHELL STIRLING ENGINE

This application is a continuation-in-part of U.S. patent application Ser. No. 08/971,235 filed on Nov. 15, 1997 now U.S. Pat. No. 6,041,598.

BACKGROUND OF THE INVENTION

1. Field of the Invention

The present invention relates to Stirling Engines. More particularly, the invention relates to improvements in (1) maximum operating temperatures, (2) the regenerator to maximize performance, (3) a throttling system designed for low cost and maximum performance, (4) high pressure shaft sealing to allow external drives, (5) control of the displacer piston, (6) heat transfer tubing, and (7) a gas burner to provide heat to the engine.

2. Background Information

Stirling engine performance improvements are continually being sought to increase the benefit of these energy conversion devices and allow large scale commercial introduction into the marketplace. Cost reduction has also been a key research area for these engines due to their increased complexity over open cycle engines such as the Internal Combustion and Brayton engines which have achieved extensive commercialization success.

The maximum Stirling engine efficiency is related to the Carnot efficiency which is governed by the ratio of maximum working fluid temperature relative to the minimum fluid temperature. Improvements in technologies which increase the margin between the two temperature extremes is beneficial in terms of total cycle efficiency. The lower working fluid temperature is typically governed by the surrounding air or water temperature; which is used as a cooling source. The main area of improvements result from an increase in the maximum working temperature. The maximum temperature is governed by the materials which are used for typical Stirling engines. The materials, typically high strength Stainless Steel alloys, are exposed to both high temperature and high pressure. The high pressure is due to the Stirling engines requirement of obtaining useful power output for a given engine size. Stirling engines can operate between 50 to 200 atmospheres internal pressure; for high performance engines.

Since Stirling engines are closed cycle engines, heat must travel through the container materials to get into the working fluid. These materials typically are made as thin as possible to maximize the heat transfer rates. The combination of high pressures and temperatures has limited Stirling engine maximum temperatures to around 800° C. Ceramic materials have been investigated as a technique to allow higher temperatures, however their brittleness and high cost have made them difficult to implement.

U.S. Pat. No. 5,611,201, to Houtman, shows an advanced Stirling engine based on Stainless Steel technology. This engine has the high temperature components exposed to the large pressure differential which limits the maximum temperature to the 800° C. range. U.S. Pat. No. 5,388,410. to Momose et al., shows a series of tubes, labeled part number 22 a through d, exposed to the high temperatures and pressures. The maximum temperature is limited by the combined effects of the temperature and pressure on the heating tubes. U.S. Pat. No. 5,383,334 to Kaminishizono et al, again shows heater tubes, labeled part number 18, which are exposed to the large temperature and pressure differentials. U.S Pat No. 5,433,078, to Shin, also shows the heater tubes, labeled part number 1, exposed to the large temperature and pressure differentials. U.S Pat. No. 5,555,729, to Momose et al., uses a flattened tube geometry for the heater tubes, labeled part number 15, but is still exposed to the large temperature and pressure differential. The flat sides of the tube add additional stresses to the tubing walls. U.S Pat. No. 5,074,114, to Meijer et al., also shows the heater pipes exposed to high temperatures and pressures.

The next item, in the Stirling engines, which is critical to the maximum performance is the regenerator. This device must heat and cool the working fluid for each cycle of the engine which may be 20 to 100 times per second. The regenerators which have been typically used in the past have been mesh screen type regenerators. The regenerators are a very dense packing of fine mesh screens into layers which are hundreds of screens thick. The fine screens and multiple layers are required to transmit the heat at the very high rate requirements. These screen regenerators have significant pressure drop as the working fluid, typically Helium, Hydrogen, or Air, moves through the mesh at high speeds. The performance of the Stirling engine is thusly limited by the use of mesh screens. For very small Stirling engines a single annular slot has been used with success. The slot reduces the pressure drop but is limited by the amount of surface area in a single slot regenerator. U.S Pat. No. 5,388,410, to Momose et al., shows the mesh regenerator located inside the heating and cooling tubes, labeled part number 25. An improvement to this design is shown in this patent as part number 26. This patent uses a series of small annular pipes placed inside the heater pipe. The maximum heat transfer rate is limited by the minimum pipe diameter. The small tubes also touch each other on their exterior which blocks the working fluid flow.

Throttling of Stirling engines is typically accomplished by varying the amount of working fluid inside the engine. With this technique a significant amount of pumping and valving hardware is required to move the working fluid. This is complicated by the high working pressures which increases the size of the pumping hardware. A second technique to throttle the Stirling engine involves opening ports within the engine which are connected to dead volumes. This technique increases the total system volume which lowers the power but also results in a significant reduction in efficiency due the larger dead volume which the engine is exposed to for the entire piston stroke. U.S. Pat. Nos. 5,611,201 and 5,074,114 are unique in the use of a variable angle plate connected directly to each piston. Reducing the plate angle results in reduced movement of the piston resulting in reduced power levels. The throttling technique, using the plate angle, has the disadvantage of a higher system weight due to the large loads generated when converting the wobble motion of the plate to torque.

A further feature, which has been a significant problem for Stirling engines, is the sealing system. If a Stirling engine with a pressurized crankcase has an output shaft which is outside of the pressure shell it must deal with the sealing problem at the crankshaft. Working fluid leakage, at the seals, is a large problem for external shaft systems. The seal problem is overcome by placing a generator or pump inside of the Stirling engine housing. This technique eliminates the high pressure rotating seal. The rotating seal is easier to seal relative to a sliding seal. A pressurized crankcase eliminates the need for a perfect sliding seal but requires the rotating seal. The disadvantages to the high pressure seal include the high cost and potential requirement to replace working fluid in the engine. The high pressure seals have limited lifetimes which requires replacement of the seal.

BRIEF SUMMARY OF THE INVENTION

The Stirling engine described in this patent is unique in its use of an insulating dual shell containment system. The outer shell provides a time varying pressure field which significantly reduces the pressure differential on the critical high temperature components allowing the engine to operate at significantly higher temperatures. The shell is filled with a liquid material which provides an insulating and approximately incompressible region. The liquid has a fiber material dispersed throughout the shell to prevent convection currents in the liquid.

An improved annular regenerator provides the required heat transfer characteristics with reduced pressure losses through the matrix. The regenerator has the additional benefit of using a material with preferential thermal conductivity in the direction perpendicular to the flow direction. This allows maximum heat absorption at a given regenerator location and minimal heat loss through conduction along the axial direction.

The throttle uses a series of venting ports located along the travel of the power piston. The ports can be selectively vented to the lower housing, thereby reducing the power output. The throttle provides a simple and robust mechanism for efficiently operating the engine at partial throttle.

A dual chamber seal system at the crankshaft isolates the working fluid in an inner chamber preventing fluid losses. The outer chamber is pressurized with the ambient environment so that it can be repumped with outside gasses.

A wobble plate is attached to the crankshaft and connected to a connecting rod which controls the displacer piston so that the displacer piston operates approximately 90 degrees out of phase with the power piston. In one embodiment the wobble plate has a circumferential bearing on its outside to which the connecting rod attaches. In another embodiment the wobble plate is a cam and the connecting rod has a follower interacting with the cam.

The heat exchange conduits for the heater head are preferably U-shaped and have an outer surface and a plurality of longitudinal tubes disposed inside of and adjacent the outer surface. The heat exchange conduits include a tubular element and a star channel element disposed inside the tubular element. The star channel element is an elongated body having an external surface with a plurality of longitudinal grooves, which are located adjacent the tubular element, to form the longitudinal tubes. The star channel element preferably has a tapered point on at least one end to direct the flow of working fluid into the grooves.

The heat is applied to a Stirling engine through a heater tube, and a continuous heat extraction burner assembly is provided for use with the heater tube. The burner assembly includes a tubular central air inlet and a tubular central fuel inlet located within the air inlet. An integrated series of heat absorbers are positioned radially around the outer lower portion of the central air inlet within the burner exhaust annulus and extend to a tubular shaped burner shell which is received by the heater tube. The burner shell has a plurality of apertures aligned with the heat absorbers, and each of the heat absorbers has an internal cavity which is in fluid communication with the space between the burner shell and the heater tube through an aperture. A liquid metal, preferably silver fills the internal cavity of each heat absorber and also wets and fills the space between the burner shell and the heater tube to efficiently transfer heat from the heat absorbers to the heater tube.

Near the outlet central air inlet, the burner shell has a hemispherical bottom which forms a flow reversing area in which fuel and air are mixed and directed upward toward the heat absorbers. Vertical adjustment of the central fuel inlet relative to the central air inlet determines the location downstream of the fuel combustion process. The goal is to have the combustion process occur among the heat absorbers which remove the combustion heat thereby lowering the flame temperature. The primary benefit of the continuous heat extraction burner is in the ability to control maximum flame temperature within the burner, which reduces the formation of nitrous oxide.

BRIEF DESCRIPTION OF THE DRAWINGS

FIG. 20 is a perspective view of a multi-cylinder arrangement of the engine of FIG. 1 connected to a housing for an electrical generator.

FIG. 21 is a cross-sectional view of a portion of FIG. 1 showing another embodiment of the juncture between the salt shell and the pressure shell assembly.

DETAILED DESCRIPTION

Figure 1:
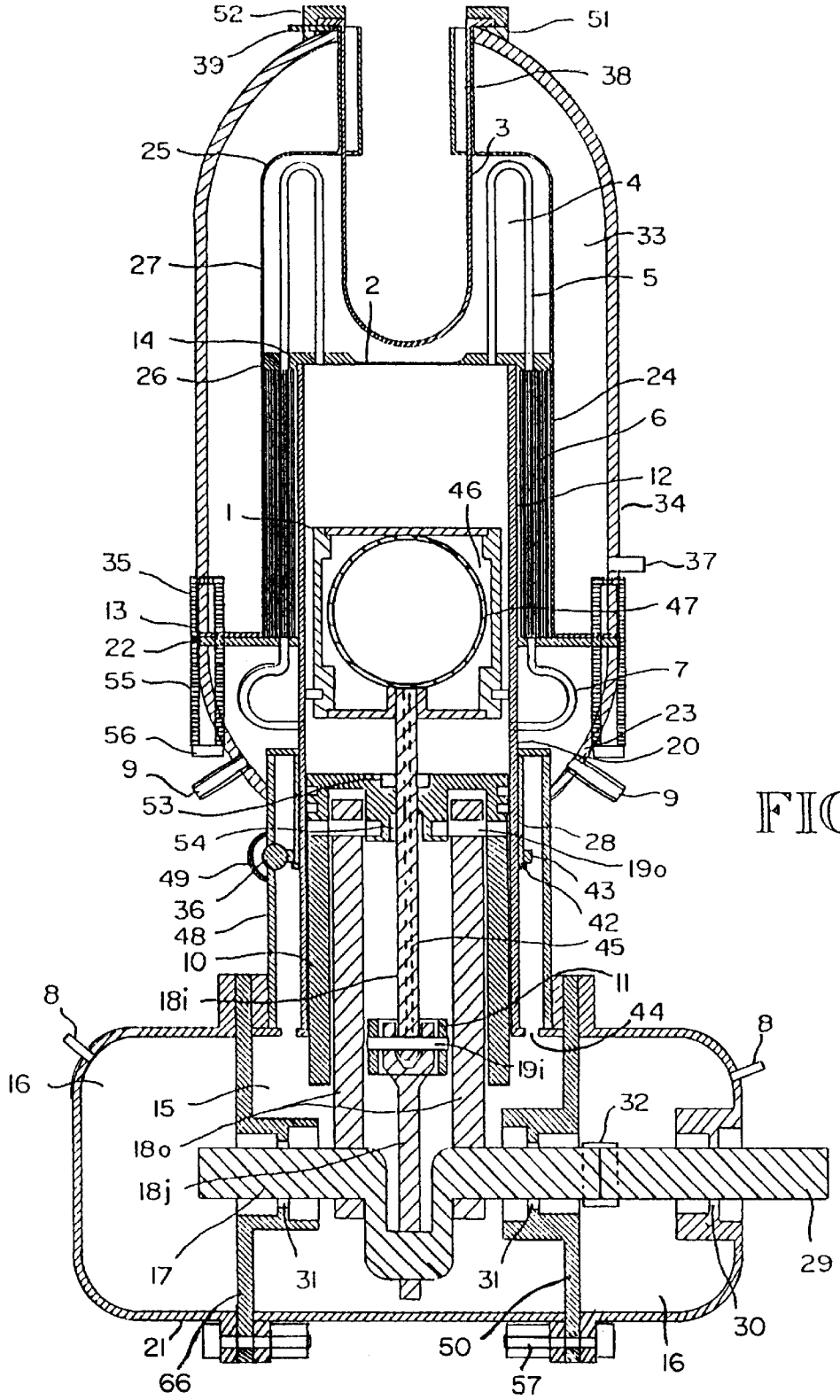
FIG. 1 is a longitudinal vertical cross sectional view showing the overall arrangement for a complete Stirling engine system.

FIG. 1 shows a longitudinal sectional view of a Stirling engine system of the present invention designed to produce rotary shaft power. The view indicates the overall integration of the unique features of this design.

The Stirling engine can be run to produce either power out or as a heat pump providing cooling. The difference is determined by whether the displacer phase angle is ahead of or behind the power piston. The engine operates by supplying heat to the heater tube 3 and cooling with the set of cooling fluid ports 9. A rotary motion is imparted to the crankshaft 17 by some means. Once the Stirling engine starts to spin, it is self sustaining. The motion causes the power piston 10 to produce power to the crankshaft 17. The displacer piston 1 forces working fluid back and forth between the chamber directly below the displacer piston 1 and the chamber directly above the displacer piston 1. The working fluid must pass through the heat transfer tubing 5, regenerator 6, and the cooling pipes 7 in the process.

The cylinder 20 is attached to the lower housing 21 and contains both the power piston 10 and the displacer piston 1. To produce shaft power the displacer piston 1 is attached, through the set of connecting rods 18*i* and 18*j*, to the crankshaft 17 at an angle which is 60 to 120 degrees ahead of the set of outer connecting rods 18*o* and power piston 10. The lower piston, the power piston 10, provides the power to the crankshaft 17.

The upper piston, the displacer piston 1, is driven by the crankshaft 17 and provides the means to move the working fluid between the chamber directly below the displacer piston 1 and the chamber directly above the displacer piston 1. To move from the region below the displacer piston 1 to the region above the displacer piston 1 the working fluid must be forced, by the action of the displacer piston 1 moving down, to move through the set of cooling pipes 7 through the graphite regenerator 6 and through the set of heat transfer tubing 5. To move the working fluid from the region above the displacer piston 1 to the region below the displacer piston 1 the working fluid must be forced, by the action of the displacer piston 1 moving upwards, to move from the heat transfer tubing 5 through the graphite regenerator 6 and through the cooling tubes 7. The function of the heat transfer tubing 5 is to move heat from the liquid metal region 4 into the working fluid. The function of the cooling pipes 7 is to move heat from the working fluid into the cooling fluid which is located inside the cooling housing 23.

Pistons

FIG. 1 shows a dual piston arrangement connected directly to a crankshaft 17. The top piston is a displacer piston 1 and the bottom piston is a power piston 10. The displacer piston 1 is approximately 60 to 120 degrees out of phase with the power piston 10. The design is set-up to produce power from a supplied heating and cooling source. The phase angle, between the two pistons is set-up so that as the power piston 10 is reaching top dead center the displacer piston 1 is moving down. The displacer phase is therefore leading the power phase by the 60 to 120 angle.

The two pistons move vertically inside a cylinder 20. Piston rings are shown on each piston. Both the power piston 10 and the rod guide 11 have axial bearings, not shown, mounted on the side flanges. The power piston 10 has a set of axial bearings, in at least three locations around the piston flange, which roll on the inside wall of the cylinder 20.

The displacer piston 1 has an internal sphere 47 which is vented to the Helium chamber 15 by the displacer vent 45 shown inside of the upper connecting rod 18*i*. The sphere provides a structurally efficient low thermal region between the top and bottom of the displacer piston 1. The displacer vent 45 maintains the sphere at the Helium chamber 15 pressure. A displacer salt region 46 fills the region between the sphere and the piston. The displacer internal sphere 47 can be filled with an insulation material or reflective foil to minimize heat loss across the sphere. The displacer salt region 46 also has a filler material in the same region as the salt which minimizes heat loss by reducing the movement of the liquid salt. The filler material could be a ceramic mat or similar substance.

FIG. 1 shows the displacer piston 1 with a set of two rods connected in series. The rod connecting to the displacer piston 1 is an upper connecting rod 18*i*. The rod connecting from the upper connecting rod 18*i* to the crankshaft 17 is a lower connection rod 18*j*. The displacer piston 1 is attached to the upper connecting rod 18*i* with a rigid connection at the bottom of the piston. The lower connecting rod 18*j* is pinned to the upper connecting rod 18*i* with the connecting pin 19*i* which is attached to the rod guide 11. The upper connecting rod 18*i* passes through a rod guide 11 which keeps the upper connecting rod 18*i* in a purely vertical motion at the pistons. The pin is necessary due to the vertical motion of the rod 18*i* and the swinging motion of the rod 18*j*. The rod guide 11 has two axial bearings, not shown, which are located between the outer edge of the rod guide 11 and the inside of the power piston 10. Roller bearings are located on the ends of both the upper and lower connecting rods 18*j*.

The power piston 10 has a power piston seal 53 and a power piston axial bearing 54 located inside the power piston 10. The upper connecting rod 18*i* rides in the seal 53 and bearing 54. The power piston seal 53 is shown pressed into the top of the power piston 10. The power piston axial bearing 54 is shown pressed into the bottom of the power piston 10. Both the seal and bearing have the upper connecting rod 18*i* passing through at the power piston 10 and are used to minimize working fluid movement and provide reduced friction between the power piston 10 and the upper connecting rod 18*i*.

The Power piston 10 has a set of two identical outer connecting rods 18*o* both of which are attached to the crankshaft 17 and to the power piston 10 with a set of connecting pins 19*o* providing a rotating joint at the power piston 10. A bearing is located at each end of the outer connecting rods 18*o* to minimize friction. The crankshaft 17 is designed to allow bearings to slide over the shaft end and to the appropriate locations where they attach with the connecting rods 18*j* and 18*o*.

The complete assembly is lubricated with dry Boron Nitride powder.

Working Fluid Containment

For the engine to function the lower housing 21 is pressurized with a quantity of the working fluid; air, Helium, or Hydrogen. If the output shaft 29 is removed and the crankshaft 17 is connected to a generator or pump, both not shown, by the shaft fitting 32 so that all the rotating systems are inside the lower housing 21 then containing the working fluid is easily accomplished with static seals. In this case the complete lower housing 21 could be filled with the working fluid. When the engine is stationary the compressed working fluid will slowly move into the upper cylinder 20 past the piston rings. If the output shaft 32 is used to produce rotary motion outside of the lower housing 21 then working fluid leakage is addressed as follows.

The cylinder 20 is attached directly to a lower housing 21 and forms a sealed unit, except for the top of the cylinder. The lower housing 21 consists of a central section and a set of two crankshaft end plates 50 which divide the space inside the lower housing into the central helium chamber 15 and two outer air chambers 16. The separate air chambers 16 ease the scaling problem with the output shaft 29 going from a high pressure Helium chamber 15 directly to the ambient air. The two crankshaft end plates 50 arc bolted at the flange locations to the central section using a number of lower housing bolts 57. The end plates 50 are fitted with a set of low pressure seals and bearings 31. The output shaft 29 has a high pressure seal and bearing 30 located where the output shaft 29 penetrates the wall of the lower housing 21. A buffer fluid, air; is in the air chamber 16 next to a high pressure seal and bearing 30. Air chambers 16 are held at approximately the same pressure as the Helium. This maintains a low pressure differential across seal and bearing 31 and allows use of a simple low pressure seal and bearing 31 between the Helium chamber 15 and air chambers 16 to isolate the Helium inside the Helium chamber 15 and to center the crankshaft 17.

It is preferable to have both chambers 16 filled with air to allow for disassembly of the lower housing ends, relative to the helium chamber 15, for bearing lubrication and maintenance. However, only the chamber 16 adjacent the output shaft 29 could be filled with air and the other chamber could be connected to the Helium chamber 15.

The lower housing could use both external and internal power output systems. A generator, not shown, represents a typical device which could be internally attached to the crankshaft 17 at a shaft fitting 32.

Since the crankshaft 17 bearings are sealed against the Helium, in the air chambers 16, it is possible to use oil in the air regions to lubricate the three bearings. The flanges located on either end of the lower housing 21 allow access to the bearings and crankshaft region.

Dual Shell Containment System

The top of the cylinder 20 is capped with a pressure shell assembly 27. The pressure shell assembly 27 consists of the outer shell 24, a dome 25, a dome plate 26 and an outer flange 13, preferably all welded together. The outer flange 13 is attached to the salt shell 34, preferably by welding, and bolts to a cooling flange 22 at a number of upper shell attachment fitting 35 locations. The dome 25 is also attached to the salt shell 34. The upper shell attachment fittings 35 are bolted to a set of lower shell attachment fittings 55 using a set of shell bolts 56. This pressure shell assembly 27 forms a tight removable joint with the cylinder 20 at a snug fit joint 14 located at the top of the cylinder 20.

A salt shell 34 surrounds the pressure shell assembly 27. The salt shell 34 contains a low melting point salt mixture which remains a liquid over the operating temperature of the salt shell 34 and the pressure shell assembly 27. A workable salt for this region would be Boron Anhydride or a mixture of Boron Anhydride and Bismuth Oxide. A filler material such as a ceramic fiber or similar material is placed in a liquid salt region 33. The salt shell 34 has a reinforcing salt shell fitting 51 attached at the top where the heater tube 3 attaches. The heater tube 3 is shown as a single tube which is sealed at the bottom and is attached to the salt shell fitting 51 at the top. A salt shell cap 52 attaches to the salt shell fitting 51. A heater tube insulation 38 is located inside the heater tube 3 and separates the salt region from the heater tube 3. Both the dome 25 and salt shell 34 have access ports for filling and draining fluids. The liquid metal is accessed through a liquid metal port 39. The liquid salt is accessed through a salt port 37 used to drain and fill the liquid salt region 33.

The dual shell containment system provides a time varying pressure field which matches the working fluid pressure in the cylinder 20 above the power piston 10. The pressure field provides a low pressure differential on the heat transfer tubing 5 so that it can be operated at significantly higher temperature levels relative to a system which does not have the pressure field matching.

To transmit the pressure field from the Helium working fluid in the cylinder 20 to the outside of the heat transfer tubing 5 the liquid salt region 33 is used. The combination of the pressure shell assembly 27 and the salt shell 34 completely contain the liquid salt region 33 which surrounds the Helium working fluid. The outer shell 24 provides a flexible metal surface which transmits the time varying pressure field from the Helium to the liquid salt region 33. The liquid salt region 33 is an approximately incompressible and insulating region which can transmit the pressure forces with minimal fluid motion. An insulating filler material is mixed with the liquid salt to prevent the liquid salt from moving due to thermal gradients within the salt. The region between the dome 25 and the dome plate 26 is liquid metal region 4 which is completely filled with a highly thermally conductive liquid metal, preferably sodium, which surrounds heat transfer tubing 5. The dome 25 transmits the pressure field to from the liquid salt region 33 to the liquid metal region 4 which acts as a conducting approximately incompressible fluid. The liquid metal transmits the pressure field to the heat transfer tubing 5.

A second method for transmitting the time varying pressure field is shown with the expansion bellows 2 located inside of the dome 25 and machined or attached to the dome plate 26. The expansion bellows 2 provides a direct pressure path from the Helium to the liquid metal region 4.

The dome region of the Stirling design is unique in its use of the liquid metal region 4 surrounding the heat transfer tubing 5 and the liquid salt region 33 surrounding the pressure shell assembly 27. The expansion bellows 2 and the outer shell 24 allow the dome region to pressurize to approximately the same pressure as the heat transfer tubing 5 internal pressure. The result is an almost zero stress on the heat transfer tubing 5. This is typically a limiting factor in maximum Stirling temperature. It also means that lower cost materials can be used for the heat transfer tubing 5 due to the lower stresses. The liquid metal chosen depends on operating conditions. High heat transfer materials, such as Sodium, work well for modern Stirling engines for the liquid metal region 4. The use of the heater tube 3 which is central among the heat transfer tubing 5 allows the liquid metal region 4 to efficiently transfer the required heat flux using both conduction and convection transfer mechanisms. Conduction is heat transfer across two non-moving surfaces which are next to each other. Convection is heat transfer due to a moving fluid past a stationary surface. Convection is typically significantly higher in heat transfer rate than conduction.

Heater Tube

The pressure shell assembly 27 also has at least one heater tube 3 attached through the dome 25. The position, number, and size of the heater tube is determined by the specific engine requirements. The heater tube 3 is designed to carry the pressure differential between the inner liquid metal region 4 and the ambient conditions. A Titanium-Zirconium-Molybdenum alloy TZM works well for the heater tube 3. The heater tube 3 can be either a single tube, as shown in FIG. 1, or it can be a group of tubes. The top of the heater tube is a region where a heat source can be inserted. The heat supply can be from a variety of sources, including but not limited to; combustion, heat pipe, thermal siphon, Nuclear, or Solar. The heater tube insulation 38 region is shown separating the inside of the heater tube 3 and the liquid salt region 33. The liquid metal port 39 is used to fill and drain the liquid metal region 4. The heater tube 3 is inserted inside the top of the dome 25 which extends up and attaches to the salt shell 34. The heater tube 3 attaches to the salt shell 34 at the salt shell fitting 51 in the top of the salt shell 34. The attachment of the heater tube 3 to the salt shell fitting 51 can use a brazing attachment which is more tolerant of the expansion mismatches which can occur at this junction. The salt shell cap 52 is attached over the heater tube 3 attachment to help maintain the seal.

Shell Juncture

Referring to FIG. 21, another embodiment for the dual shell arrangement is illustrated where the pressure shell assembly 27 is not directly connected to the salt shell 34. Heater tube 3 is attached to the salt shell 34 at salt shell fitting 51 thereby forming a pressure vessel containing salt in the liquid salt region 33. The pressure shell assembly 27 encloses the liquid metal region 4 and heat transfer tubing five, and includes dome 25 and extension 110. Extension 110 is a vertically oriented cylinder with its lower end attached to dome 25 and an upper end 112 terminating to leave a gap between it and salt shell 34. The gap accommodates thermal expansion of the pressure shell assembly 27 allowing relative movement between pressure shell assembly 27 and salt shell 34.

Heater tube 3 extends downward into the cylindrical shape of extension 110 forming an annular space between heater tube 3 and extension 110. As relative movement occurs between pressure shell assembly 27 and salt shell 34, salt from the liquid salt region 33 and liquid metal from liquid metal region 4 move along the annular space between extension 110 and heater tube 3. Since the liquid salt is less dense than the liquid metal in liquid metal region 4, the liquid salt will float on the liquid metal thereby forming an interface 114 between the liquid metal and the liquid salt. The interface 114 moves vertically along the gap between heater tube 3 and extension 110 as relative movement between pressure shell assembly 27 and salt shell 34 occurs. The annular gap between heater tube 3 and extension 110 is sized to allow sufficient volume in the gap so that the interface 114 remains within extension 110 throughout the range of relative movement between pressure shell assembly 27 and salt shell 34.

Cooling System

The cooling system, in FIG. 1, is located at the base of the cylinder 20. The cooling system consists of a set of cooling pipes 7 located inside a cooling housing 23. The cooling housing 23 is shown with a set of cooling pipes 7 brazed from the cooling flange 22 to the cylinder 20. The number, size, and length of cooling pipes 7 varies with different engine sizes. The cooling housing 23 is filled with a cooling liquid such as water. Two cooling fluid ports 9, shown on opposite sides of the cooling housing 23, allow the water to move in and out of the cooling housing 23.

The bottom edge of the cooling housing 23 is attached to the lower portion of the engine at the throttle housing 48. Cooling flange 22 extends from the cooling housing 23 to the cylinder 20 and is attached to both. The cooling flange 22 attaches to the pressure shell assembly 27 at the outer flange 13 with a gasket between them to join the top of the engine with the cooling region to form a completely sealed vessel. A series of lower shell attachment fittings 55 and a set of shell bolts 56 are used to make the connection.

Heat Transfer Tubing

The pressure shell assembly 27 has a set of heat transfer tubing 5 located inside of the dome 25 and attached to the dome plate 26. This section of the engine is called the heater head and provides a mechanism to move heat from an outside heat source into the working fluid of the Stirling engine. The heater tube 3, as shown in FIG. 1, provides the heat source for the dual shell Stirling engine. The liquid metal region 4 is used to transfer the heat from the heater tube 3 into the heat transfer tubing 5. The heat transfer tubing 5 are welded to the dome plate 26 at two locations for each tube. All of the heat transfer tubing 5 have one end welded to the region which is directly above the cylinder 20. The second end of the heat transfer tubing 5 is welded above the annulus formed between the outer shell 24 and the cylinder 20. The number, size, and length of heat transfer tubing 5 varies with different engine sizes.

Figure 11:
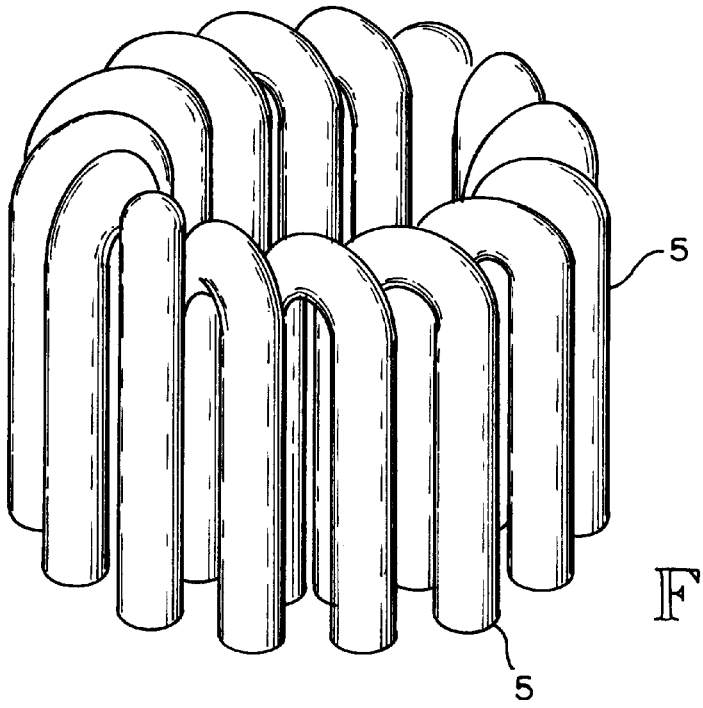
FIG. 11 is a perspective view of a circular array of heat transfer tubing used in the engine of FIG. 1.
Figure 12:
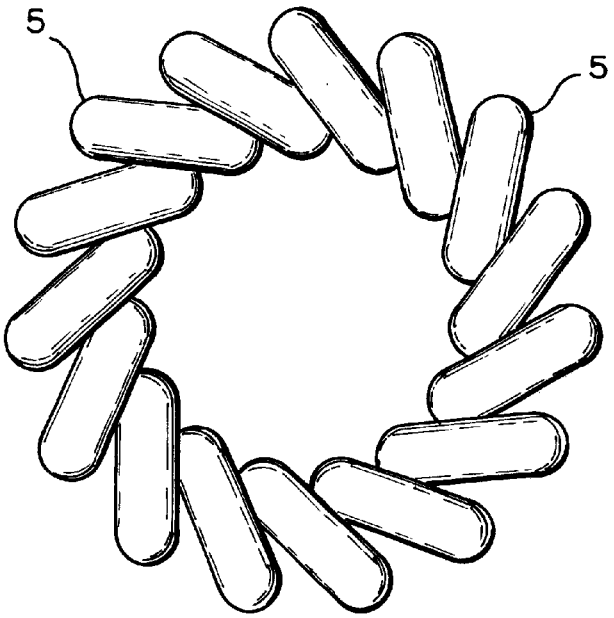
FIG. 12 is a top view of the tubing of FIG. 11.
Figure 13:
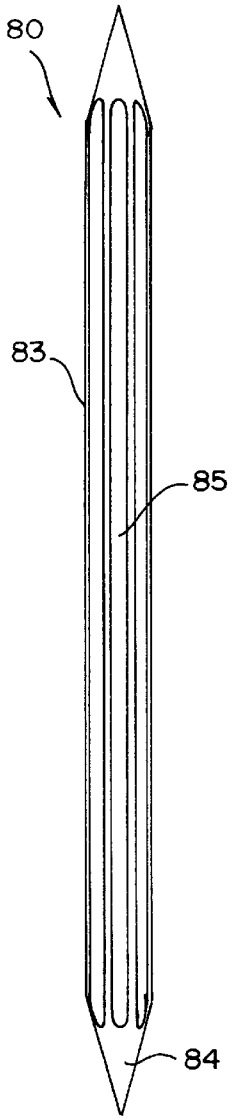
FIG. 13 is a side view of a star channel insert located inside the heat transfer tubing of FIG. 11.
Figure 14:
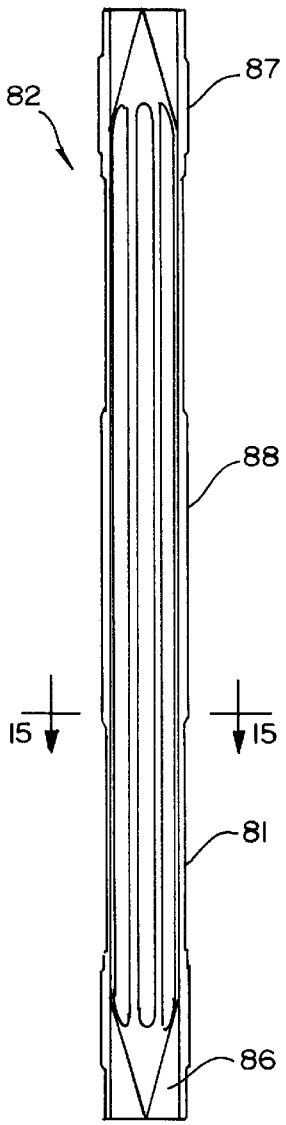
FIG. 14 is a side view of the star assembly illustrating how the star channel of FIG. 13 installs in the tubular star housing, with the tubular star shown cut away in cross section.
Figure 15:
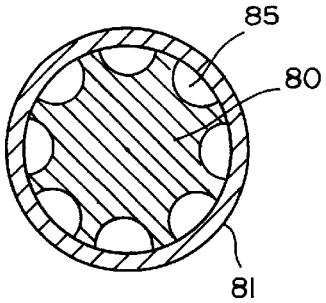
FIG. 15 is a sectional view taken along line 15—15 of FIG. 14.

Heat transfer tubing 5 is arranged in a circular array such as illustrated in FIGS. 11 and 12 and is generally referred to as the multi-port heater head star. In the example illustrated, fifteen sections of heat transfer tubing 5 are used, but the number can vary depending upon the diameter of the tubing and the diameter of the cylinder. Referring also to FIGS. 13–15, each section of heat transfer tubing 5 preferably uses a pre-manufactured central star channel 80, which has a number of longitudinal grooves running down its length and a pointed region at each end. The star channel is inserted into a tube and is diffusion-welded to it to form a star assembly 82. The unit is then bent 180 degrees and becomes a sub-element of the heater head star assembly with each end welded to a common plate. Bending can be accomplished without distortion of the grooves by filling the grooves with low-melting material which is removed after bending. FIGS. 11 and 12 show 15 star assemblies 82 bent 180 degrees and positioned so as to be attached to the dome plate 26 shown in FIG. 1.

The heat transfer tubing 5 with internal star channel 80 provides an improvement, over heat transfer tubing 5 without the star channel, in the rate or amount of heat transferred into the engine working fluid. Further benefits of this configuration include: (1) reduced number of welds on heater head plate; (2) use of larger tubes to achieve heat transfer between internal passages and outer wall; and (3) integrated diffuser at ends of each tube assembly.

Referring again to FIGS. 13–15, the star channel 80 consists of a straight section 83 and diffuser cones 84 located on the both ends of the star-channel 80. Parallel grooves 85 run lengthwise alone the straight section 83 of the star channel 80. FIG. 13 shows eight grooves 85 for each star-channel 80, but the number may vary. The star channel 80 is press fit into a tubular star housing 81, and the interface between the star channel 80 and the star housing 81 is fused during manufacture to form the star assembly 82. Such fusing, by using diffusion welding for example, eliminates the boundary at the contact region between the star channel 80 and the star housing 81, thereby enhancing heat transfer between the two components.

The two ends of the star assembly 82 each have a diffuser region 86 which is bounded by the inner wall of the star housing 81 and the diffuser cone 84. The diffuser region 86 allows the working fluid to efficiently expand as is exits from the star housing 81, and also allows the working fluid to efficiently compress into the individual grooves 85 as it enters the star channel 80.

The star housing 81 has an integral collar 87 for reinforcement surrounding each diffuser region 86. The middle of the star housing 81 has a mid integral collar 88 which is approximately centered along the length of the star housing 81. The mid integral collar 88 thickens the outer wall on the star housing 81 in the region where the 180 degree bend occurs, and is thicker along one side and tapers to a smaller thickness along the opposite side. The purpose of this thickened region is to allow for wall thinning which occurs during the bending process. The current design has the thickened region starting at the baseline wall thickness and increasing over one side of the tube. This thickened region becomes the outside of the bent configuration.

Referring to FIG. 15, The star channel 80 is shown centered in and filling the majority of the inner volume of the star housing 81 with the eight grooves 85 located around the outside of the star channel 80. Grooves 85 and the inside wall of star housing 81 form passages through which the working fluid, such as Helium, moves. The star-channel 80 directs the working fluid through the individual grooves 85. The grooves 85 move the working fluid into regions which are closer to the outer edge of the star housing 81, thereby increasing the rate of heat transfer for a given star housing 81 size. The heat transferred into the working fluid is further increased by eliminating the boundary at the contact region between the star housing 81 and the star-channel 80 as discussed above.

The star assemblies 82 also simplify the construction of the hear head which includes welding heat transfer tubing 5 to the dome plate 26. In previous Stirling engine designs each heat transfer tubing 5 was a small diameter tube, and a great many were needed with each end being separately welded to the dome plate. If 120 tubes were used, 240 separate welds were needed for the small tubes. The star assemblies of the present invention provide multiple tubular channels in each star assembly, and each star assembly needs only one weld at each end to attach it to the dome plate. For the example as illustrated above, fifteen star channel assemblies with eight channels in each provide 120 tubular flow paths, but only 30 welds are needed for the larger diameter tubing. The fewer number of welds simplifies construction and increases reliability of the hear head.

Regenerator

The region between the outer shell 24 and the cylinder 20 is filled with a regenerator 6, preferably containing graphite fibers having a thermal conductivity that is over 100 times greater in the fiber direction, i.e. along the fiber's longitudinal axis, than in the direction perpendicular to the fiber, which consists of a carbon matrix. In the design in FIG. 1 the graphite fibers run almost 90 degrees to the fluid flow. This gives a very high thermal conductivity around the helix but very low conductivity in the fluid direction. The benefit of this differential thermal behavior is tied to the requirements of the regenerator. The top of the regenerator is at a very high temperature while the bottom of the regenerator is at a lower temperature. The regenerator operates more efficiently with very low conductivity in the fluid direction; i.e. up or down. The large heat transfer rates perpendicular to the fluid direction allow the fluid to transfer energy to and from the regenerator efficiently. The regenerator 6 may alternatively be made of metal, but the efficiency of such a regenerator is reduced.

Figure 2:
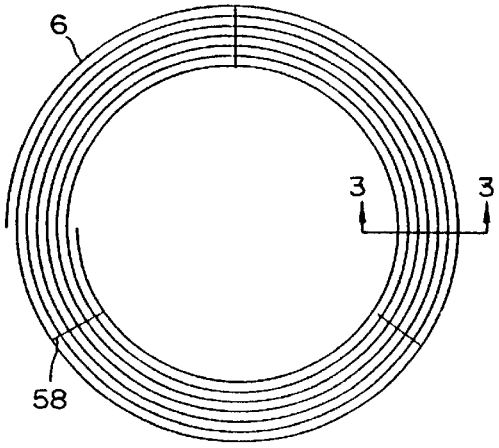
FIG. 2 is a top plan view of a spiral wrapped annular regenerator.

The regenerator 6 is a separate piece of material which can be removed from the pressure shell assembly once the outer flange 13 is disconnected. The regenerator 6 preferably consists of a coiled annulus of carbon-carbon material made with graphite fiber composites which have been heated to remove the resins which are converted to a carbon material. FIG. 2 shows a top view of the coiled regenerator 6. The gaps between each coil wrap form channels through which the working fluid passes. The coils consist of one or more layers of graphite fiber with a carbon matrix holding the layers together and adding rigidity. Ceramic string 58 is woven through the regenerator at a minimum of three locations around the circumference, with one string at each location. The ceramic string 58 is used to hold a gap between each wrap of the coil. The number of ceramic string locations is dependent on the stiffness of a given regenerator and may vary from 0 to several strings.

Figure 3:
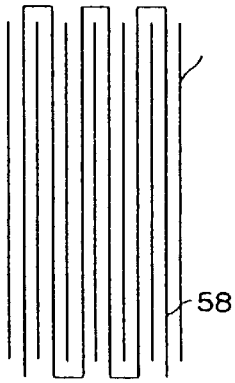
FIG. 3 is a sectional view taken along line 3—3 of FIG. 2.

FIG. 3 shows a side elevational view of the regenerator as a cut through section 3—3 in FIG. 2. The spiral regenerator is shown schematically as a series of vertical line elements. The ceramic string 58 is woven as single length of string through each layer of the regenerator.

The coil is made by laying up a prepreg uni-axial graphite tape, at a small helix angle relative to circumferential, on a non-stick backing material; such as a Boron Nitride coated steel coil. The steel coil may be only 0.01 inches thick, a little wider than the regenerator length and several feet long. The helix angle is variable but is preferred to be 5 to 15 degrees. The fiber orientation away from perpendicular increases the strength of the coil over one made with a 0 degree helix angle. A second layer of prepreg uni-axial graphite tape is applied over the first layer but with the helix 5 to 15 degrees off circumferential in the other direction. The resulting lay-up of graphite fibers would have the fibers running approximately + or −15 degrees relative to perpendicular.

The regenerator 6 is represented in FIG. 1 as a series of vertical lines. The graphite fiber lay-up would be like a loose roll of paper which is wrapped around the cylinder 20. Circumferential would then be the long direction of the roll of paper. Once the two layers of graphite fiber are cured and baked to form a carbon-carbon matrix they are unwrapped from the steel coil and formed into a loose coil which is annular in shape. Spacers are put between each layer of graphite to maintain an annular gap between each layer. A low thermal conductive material can be used as the spacer; such as a ceramic string 58. The regenerator 6 is placed inside the pressure shell assembly 27 and assembled. A layer of insulation is placed between the regenerator 6 and the cylinder 20 forming a regenerator insulation 12.

Individual graphite coil layers may be less than 0.01 inches thick with a gap between coil layers around 0.005 inches. The benefit of a coil, as opposed to other regenerator systems such as screens, is the reduced pressure drop which occurs in the coil relative to other systems. This increases the total Stirling engine efficiency while allowing very high heat transfer rates. Graphite was chosen for its high temperature and strength characteristics which make it ideal as a regenerator material. It also has a very low coefficient of expansion which reduces thermal stresses. The annular design for the regenerator can also have a regenerator insulation 12 region between the cylinder 20 and regenerator 6.

The function of the regenerator 6 is to efficiently heat the working fluid as the working fluid moves through it from the cooling pipes 7 to the heat transfer tubing 5. The regenerator 6 also functions to cool the working fluid as the working fluid moves from the heat transfer tubing 5 to the cooling pipes 7. A way to picture the function of the regenerator 6 is to visualize the regenerator 6 as a series of narrow constant temperature heat sink regions stacked on top of one another inside the regenerator 6. The temperature of the top of the regenerator is at the liquid metal region 4. The temperature at the bottom of the regenerator is at the cooling fluid temperature. If the working fluid were to flow very slowly through the narrow constant temperature regions so that the working fluid adjusts its temperature to match the local regenerator temperature; and if the working fluid accomplished this without a pressure drop as it passed through the regenerator; then a perfect regenerator would be described which minimizes the losses as the working fluid gets moved between the regions above and below the displacer piston 1. The regenerator thus needs to have very low thermal conductivity in the fluid flow direction; since one end of the regenerator is hot and the other end is cold. The regenerator also needs to have very high thermal conductivity in the direction normal to the fluid flow so that the working fluid can rapidly adjust itself to the local temperature inside the regenerator. The regenerator must also have a very large surface area to improve the rate of heat movement with the working fluid. Finally the regenerator must have a low loss flow path, for the working fluid, so that minimal pressure drop will result as the working fluid moves through.

Throttle

The Stirling engine shown, in FIG. 1, is pressurized with a working fluid such as air, Helium, or hydrogen. Pressurizing the lower housing 21 allows the system to operate without perfect internal seals at the displacer piston 1 and power piston 10. Pressurizing the lower housing 21 also allows the Helium chamber 15 to act as a reservoir for the working fluid which can be used to throttle the engine.

The lower cylinder wall 20 is ported with the throttle 28 so that when the power piston 10 is at bottom dead center the throttle ports are completely above the power piston 10 and provide fluid communication between the upper cylinder region and the Helium chamber 15 in lower housing 21. As the power piston 10 moves up the cylinder 20 the region above the power piston 10 is sealed and compressed. The start of the sealing is dependent on the throttle port sequence. The stroke is rapid enough that Teflon or Rulon rings are adequate for the two pistons for sealing. Various openings in the throttle 28 allow the working fluid to adjust to the Helium chamber 15 pressure as the power piston 10 rises thus preventing compression in the region above the power piston 10.

Figure 4:
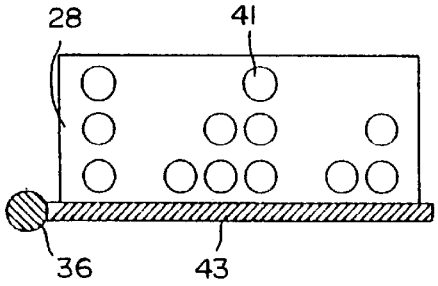
FIG. 4 is a side elevational view of the throttle ring assembly. The assembly is the movable component of the throttle system.
Figure 5:
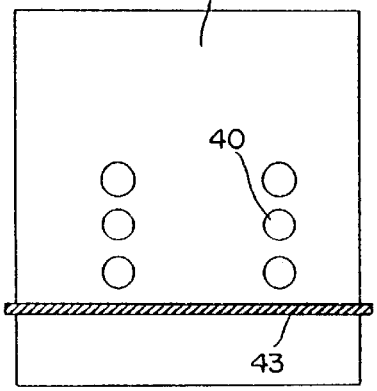
FIG. 5 is a side elevational view of a section of the cylinder in the region of the throttle.

Referring also to FIGS. 4 and 5, the throttle 28 is a sleeve that fits around the cylinder 20 with a snug fit so as to provide a seal between the throttle 28 and the cylinder 20. Cylinder 20 has a series of vertically aligned cylinder ports 40 drilled through it at several locations around the circumference as shown in FIG. 5. The throttle 28 has groups of staggered throttle ports 41 arranged around the perimeter, as shown in FIG. 4, so as to provide a stepped series of apertures which align with the cylinder ports 41 in the cylinder 20 depending on the position of the throttle 28. A blank space separates each group of throttle ports 41 around the throttle 28. A throttle collar 42 is attached to the outside of cylinder 20, and throttle 28 rides on throttle collar 42.

A worm gear 43 is attached to the throttle 28 and is driven by a throttle control worm 36 to rotate throttle 28 about cylinder 20 to the desired position. The throttle control worm 36 is shown engaged into the throttle worm gear 43 which together provide reduction gearing between the throttle drive mechanism and the throttle so as to improve the positioning accuracy of the throttle 28. An internal or external drive can be attached to the throttle control worm 36.

A throttle housing 48 encloses the throttle 28 and provides a pressure fairing for it. The bottom of the throttle housing 48 is attached to the lower housing 21, and the top to the cylinder 20. A throttle housing blister 49 located on the throttle housing 48 surrounds the throttle control worm 36 and provides a pressure fairing for the throttle control worm 36 to contain the working fluid. The throttle fairing 48 has a series of throttle vents 44 located at the lower side of the throttle fairing 48 on the surface of the lower housing 21. The throttle vents 44 provide a means for the working fluid, Helium, to move from the cylinder 20 into the Helium chamber 15 in lower housing 21.

The throttle functions by rotating the throttle 28 around the cylinder 20 through the distance of each group of throttle ports 41. The blank position between groups would provide a complete seal and full throttle conditions. As the throttle 28 is rotated, an increasing number of ports located higher on cylinder 20 are opened which allow the working fluid to vent from the area above the power piston 10 into the throttle housing 48. The higher the ports the more power piston 10 has to travel without compressing the working fluid in the cylinder 20. Once the power piston moves past the open ports the compression continues in the cylinder 20 but at a much lower level. This reduction in compression reduces the total power produced.

A unique advantage of this system is the complete scaling of the upper cylinder region after the power piston 10 has passed the open ports. The advantage of this new technique is that the engine will operate at a much higher efficiency at partial power than with a conventional dead-volume throttling system which maintains the increased dead volume over the complete stroke. The reason for this improvement is related to the Stirling cycle and its working fluid movement. During the power stroke the majority of the working fluid is heated and located above the displacer piston 1. As the power piston 10 gets pushed downward an increase in volume occurs between the displacer piston 1 and the power piston 10. This results in movement of the working fluid from the region above the displacer piston 1. With a dead-volume throttle system, a reservoir is connected to the region between the two pistons. When the working fluid moves, part of the fluid remains in the region above the power piston 1 and does useful work and part of the fluid expands into the dead volume chamber and does zero work. This extra quantity of zero work reduces the total engine efficiency. The present invention allows the working fluid to move entirely to the region below the displacer piston 1 where it expands against the power piston 10 doing useful work, thereby eliminating the zero work and improving the throttle efficiency.

Wobble Plate for Crankshaft

Figure 6:
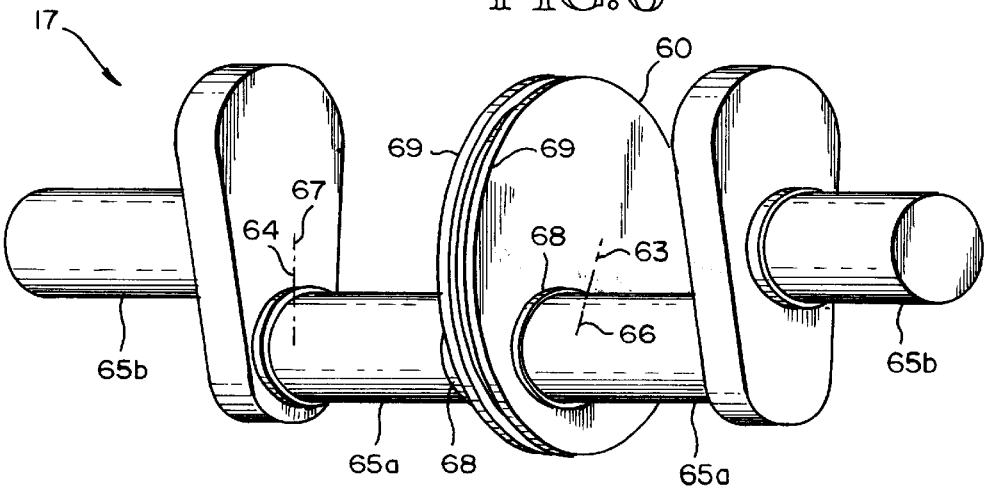
FIG. 6 is a perspective view of a crankshaft with a wobble plate for use in the Stirling engine of FIG. 1.

Stirling engines are typically divided into two groups relative to the power output mechanism: 1 Kinematic or 2 Free-piston. The free piston designs use a linear motion for the output shaft. The kinematic engines use a rotary motion whereby the power from the piston is used to drive a crankshaft. A number of piston configurations exist within Stirling engine designs due to the need for a secondary pumping piston which is used to move high pressure gases between chambers within the engine. One method of achieving this pumping is by a displacer piston, which is attached and driven by the crankshaft. For the Stirling engine design in FIG. 1 the displacer is attached to the crankshaft 17 via a central connecting rod **18*i*, 18*j* which runs through the power piston 10 and attaches to the crankshaft. There is typically an offset in the crankshaft so that the displacer operates approximately 90 degrees out of phase with the power piston. A new device is shown in FIG. 6 which comprises a wobble plate 60 attached to the crankshaft 17** and provides an improvement over existing crankshaft designs for the attachment of displacer pistons. The benefit includes a straight-line attachment to the crank adding strength with a reduced installation width.

Figure 7:
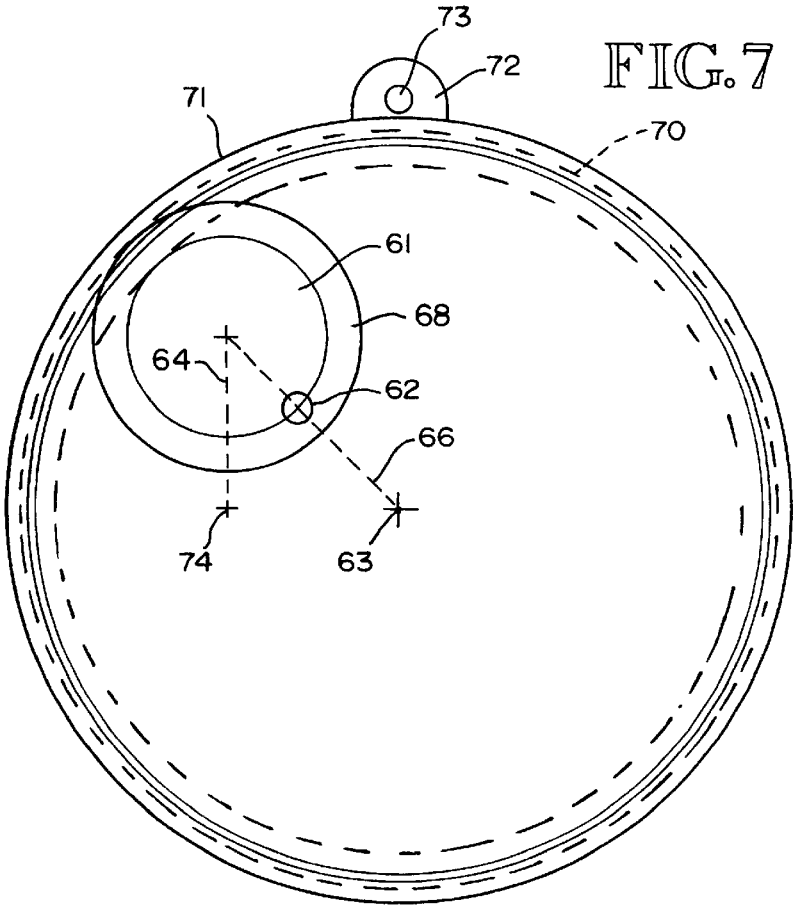
FIG. 7 is an end view of the wobble plate of FIG. 6 with attached bearing.
Figure 8:
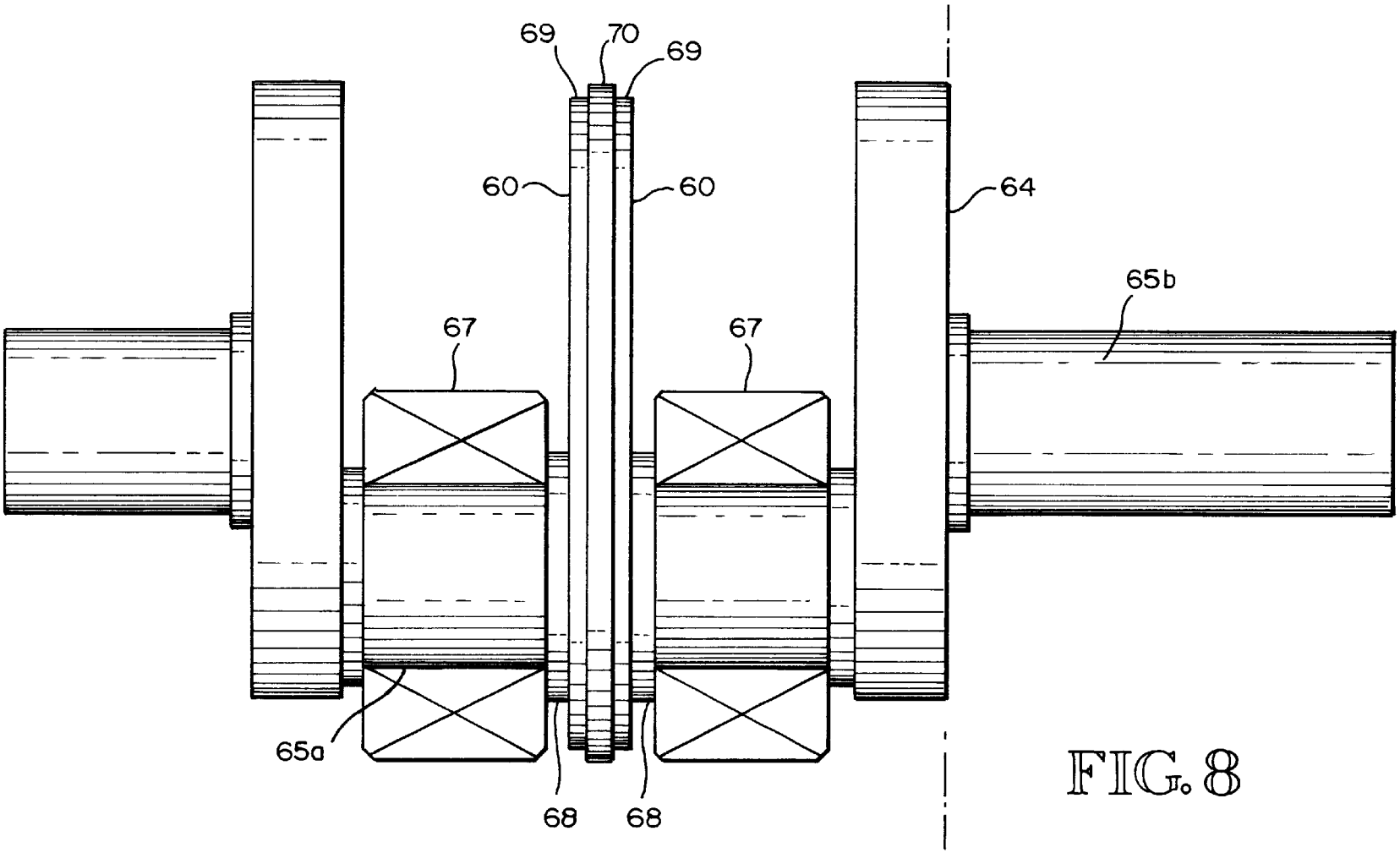
FIG. 8 is a side view of the crankshaft and wobble plate of FIG. 6 with the wobble plate bearing and connecting rod bearings shown.

Referring to FIGS. 6–8, wobble plate 60 attaches to the crankshaft 17 of FIG. 1. The wobble plate 60 slides over the central crankshaft rod 65*a* and has its angular position fixed by pin 62, which also prohibits relative rotational movement between the wobble plate and central crankshaft rod. The wobble plate 60 comprises a round flat disk, assembled from two identical round plates, with an offset aperture 61 running through the disk. The wobble plate 60 has a wobble plate offset axis 66 running from the plate center 63 to the center of the offset aperture 61, which is located at a known distance away from the plate center 63. A main offset axis 64 is defined by a line normal to the crankshaft running from the center of the central crankshaft rod 65*a* through the center of the end crankshaft rod 65*b*. The wobble plate offset axis 66 is set at a known angle from the main offset axis 64 and is set up so that a 90° projection, relative to the main offset axis 64, from the end crankshaft rod 65*b*, at the crank center 74, will approximately pass through the wobble plate center 63.

On each side of the wobble plate 60 are two bearings 67, for attachment of outer connecting rods 18*o* of FIG. 1, which keep the wobble plate from moving side to side. Two spacer collars 68 are disposed between wobble plate 60 and bearings 67 and act as spacers against the two bearings 67. The spacer collars 68 may be machined into both halves of the wobble plate 60 centered about the offset aperture 61.

Each half of wobble plate 60 has a machined outer flange 69 which forms a bearing collar on the assembled wobble plate 60 to provide a self-locking support for an outer bearing 70 which rides along the outside of the wobble plate 60 and is trapped between the two flanges 69. A cap plate 71, which is also machined in two halves, wraps around the outer bearing 70. An eyelet 72 having an eye-attachment aperture 73 through it is located on one edge of the cap plate 71. The upper connecting rod 18*i*, shown in FIG. 1, attaches to the eyelet 72 with center connecting pin 19*i* and to the displacer 1. The two halves of the cap plate 71 are bolted together through flanges around the outside of cap plate 71 similar to eyelet 72.

The motion of the wobble plate center 63 traces out a circular path about the crank center 74 of the end crankshaft rod 65*b*. The upper connecting rod 18*i* moves in an approximately parallel direction to the piston motion. The eyelet 73 provides the forces to move the upper connecting rod 18*i* and stays positioned at the upper side of the wobble plate 60. During operation of the crankshaft 17 the wobble plate 60 is both rotating and moving in an offset circular motion. The cap plate 71 does not rotate continuously due to the constraint of the eyelet 72.

The wobble plate can be made with any number of spacers and edges to contain the outer bearing and cap plate. The plates can be split or single piece assemblies.

Figure 9:
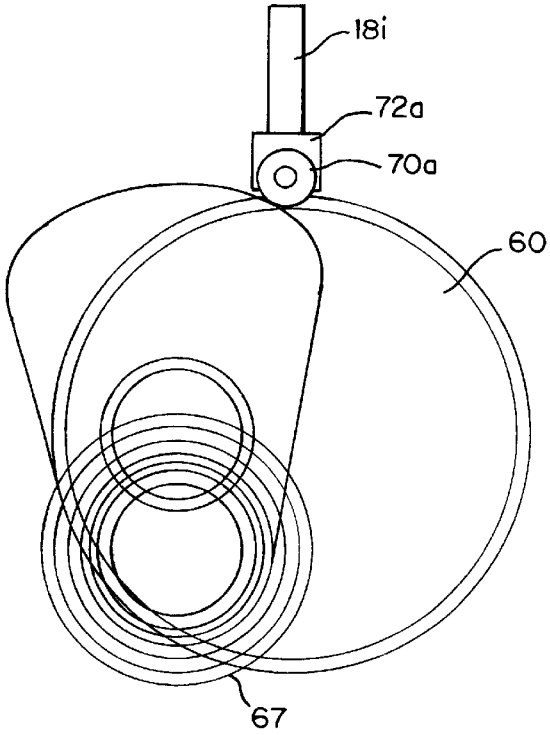
FIG. 9 is an end view of the crankshaft and a wobble plate illustrating another embodiment of the wobble plate used with a cam follower.
Figure 10:
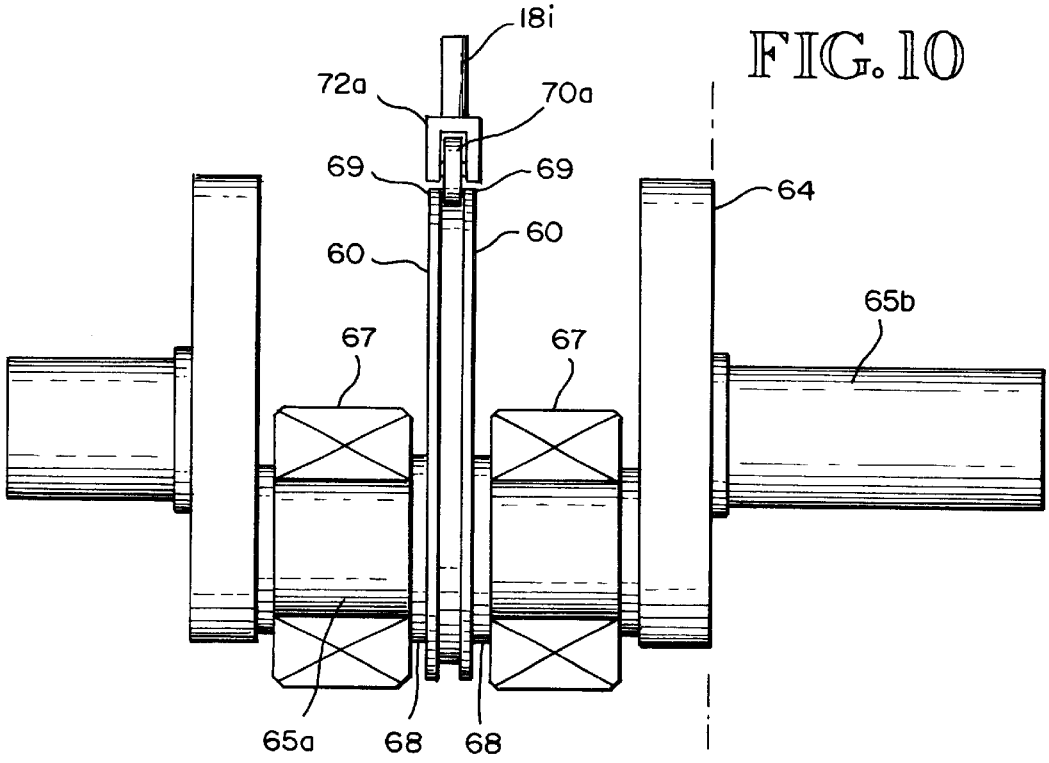
FIG. 10 is a side view of the crankshaft and the wobble plate of FIG. 9 showing the wobble plate with a cam follower.

Referring to FIGS. 9–10, in another embodiment of the wobble plate the outer bearing 70 and cap plate 71 could be eliminated by using a rod end 72*a* connected to the end of upper connecting rod 18*i* with a bearing 70*a* resting against the wobble plate 60, making the wobble plate and upper connecting rod essentially a cam and follower respectively. The bearing 70*a* runs in the groove formed between the outer flanges 69. The upper connecting rod 18*i* is spring loaded against the wobble plate 60 to keep the bearing 70*a* snug against the wobble plate 60 at the wobble plate rotates. The wobble plate 60 could then be any shape, besides round, to improve the displacer piston movement.

Continuous Heat Extraction Burner

Figure 16:
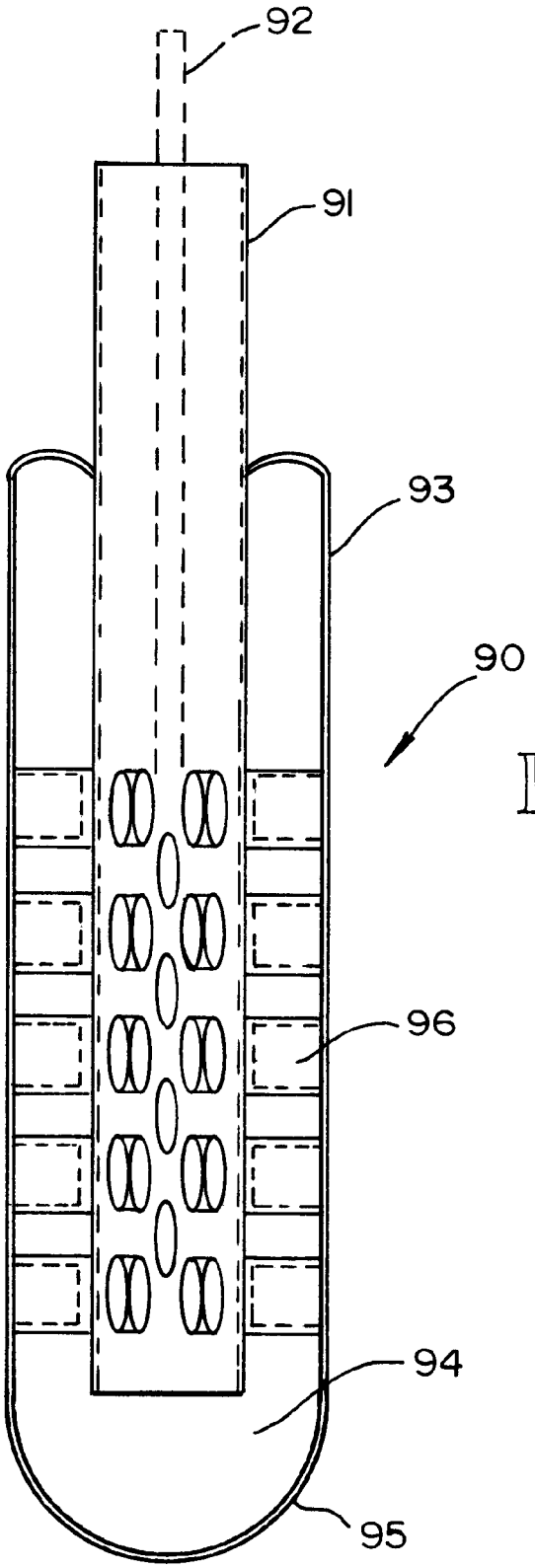
FIG. 16 is a side view of a burner assembly for used with a Stirling engine of FIG. 1 showing the burner shell cut away in cross section to show the relationship between heat absorbers and the burner shell.
Figure 17:
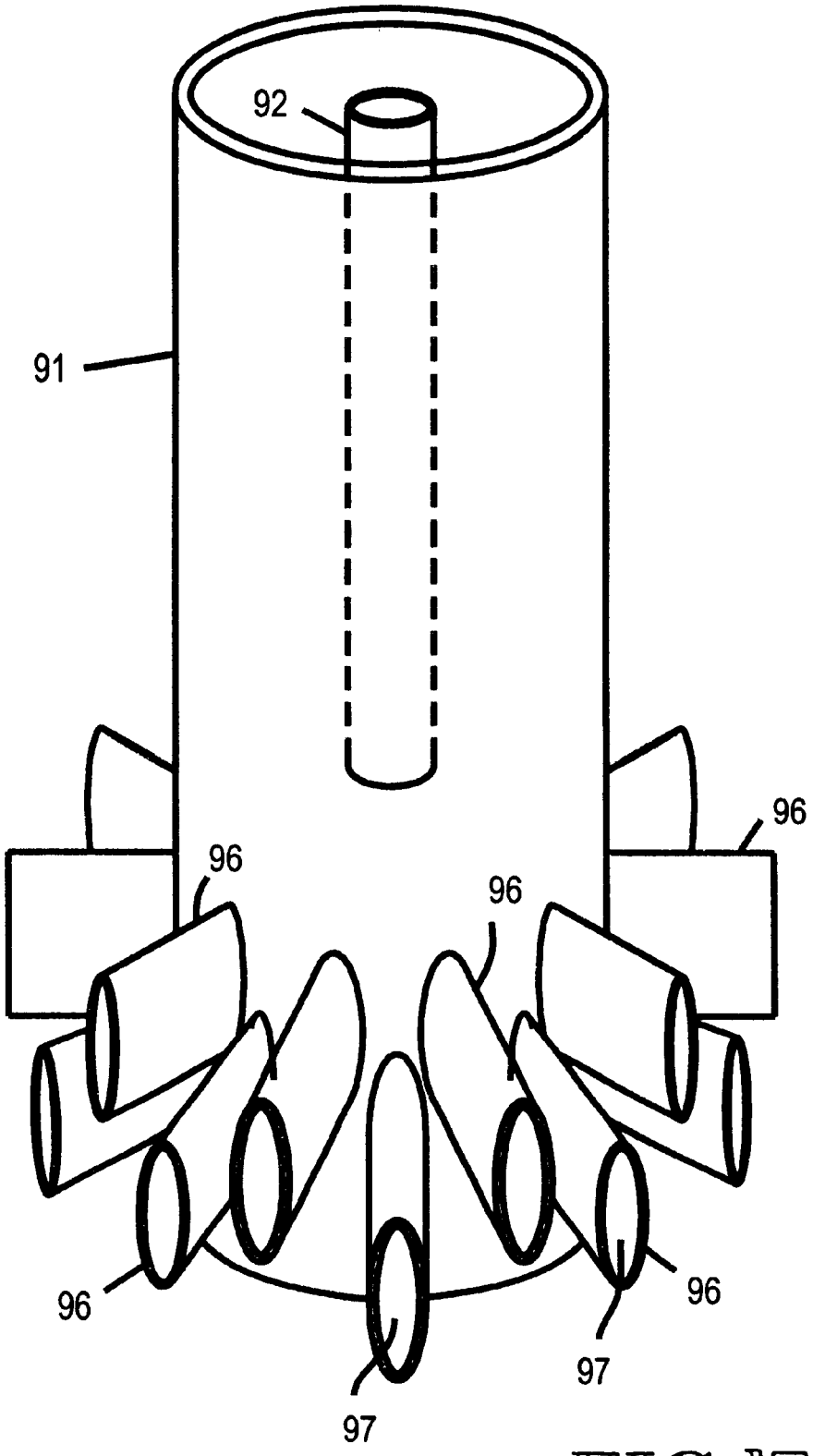
FIG. 17 is a perspective view of a portion of the burner assembly of FIG. 16 illustrating staggered spacing of heat absorbers.

Referring to FIGS. 1, 16 and 17, a burner assembly 90 for use with the Stirling engine of FIG. 1 is illustrated. The tubular shaped burner assembly 90 is received by heater tube 3. The burner assembly 90 includes a central air inlet 91 and a central fuel inlet 92 located within the air inlet 91. An integrated series of heat absorbers 96 are positioned around the lower portion of the central air inlet 91 within the burner exhaust annulus to provide an efficient mechanism to transfer heat to the burner shell 93, which forms the outer wall of the burner assembly 90 and is received by heater tube 3. The burner shell 93 is preferably coaxial with the air inlet 91 and forms a semi-closed tube, preferably with a hemispherical end 95 at its lower end which encloses a flow reversing region 94. Rows of heat absorbers 96 are located between the burner shell 93 and the central air inlet 91. The heat absorbers 96 are arranged so as to form rings of radially oriented elliptical conduits. FIG. 17 shows 10 radially oriented elliptical conduits per ring. Ten rings of heat absorbers 96 are shown stacked along the central air inlet 91. The heat absorbers 96 are positioned so as to form a nested set of rings with conduits of each ring preferably centered about the gaps of an adjacent ring of heat absorbers 96, and preferably with a slight vertical overlap between rings.

Each of the heat absorbers 96 is attached to the burner shell 93 at their outermost end. Each of the heat absorbers 96 also has an internal cavity 97 which starts on the outside of the burner shell 93 and runs most of the length of the heat absorber 96. The internal cavity 97 opens to the outside of burner shell 93 through an aperture in the burner shell and is in fluid communication with the space between burner shell 93 and heater tube 3. The internal cavity 97 is filled with a liquid metal, preferably silver. The liquid metal also wets and fills the space between the burner shell 93 and the heater tube 3 to efficiently transfer heat from the heat absorbers 96 to the heater tube 3.

The primary benefit of the continuous heat extraction burner is in the ability to control maximum flame temperature within the burner, which reduces the formation of nitrous oxide. This is accomplished by moving the central fuel inlet 92 vertically relative to the central air inlet 91 to adjust the location of the fuel outlet port at the bottom of the central fuel inlet 92 relative to the location downstream of the heat absorber 96 matrix. The location of the fuel outlet port determines the location downstream of the fuel combustion process. The lower the position of the fuel outlet port, the further downstream is the start to of the combustion process. The goal is to have the combustion process occur among the heat absorbers 96 which remove the combustion heat thereby lowering the flame temperature.

The pre-heated air, which comes in through the central air inlet 91, begins mixing with the fuel at the fuel outlet port. At the bottom of the central air inlet 91 the fuel and air thoroughly mix while reversing directions in the flow reversing region 94. The mixture starts to burn and moves into the annular region between the central air inlet 91 and the outer burner shell 93 containing the staggered rows of heat absorbers 96. The mixture speed and conditions are controlled such that the complete burn region occurs within the length of the heat absorber 96 matrix. Heat from the burning mixture is moved into the heat absorbers 96 and is channeled through an internal cavity 97, which is filled with liquid metal, preferably silver. The liquid metal transfers the heat using conductive and convective heat transfer mechanisms to the burner shell 93 and to the heater tube 3 since the liquid metal in the internal cavity 97 is in fluid communication with a liquid metal between the burner shell 93 and heater tube 3. The liquid metal between the burner shell 93 and heater tube 3 efficiently transfers heat between them and into the Stirling engine.

The benefit of this design is that it allows heat to be extracted along the annular burn path, thus maintaining a lower overall burn region temperature profile and thereby reducing the maximum operating temperature of the burner. The lower operating temperature reduces Nitrous oxide, which forms at higher burner temperatures.

Hydrogen Boundary Layer

Figure 18:
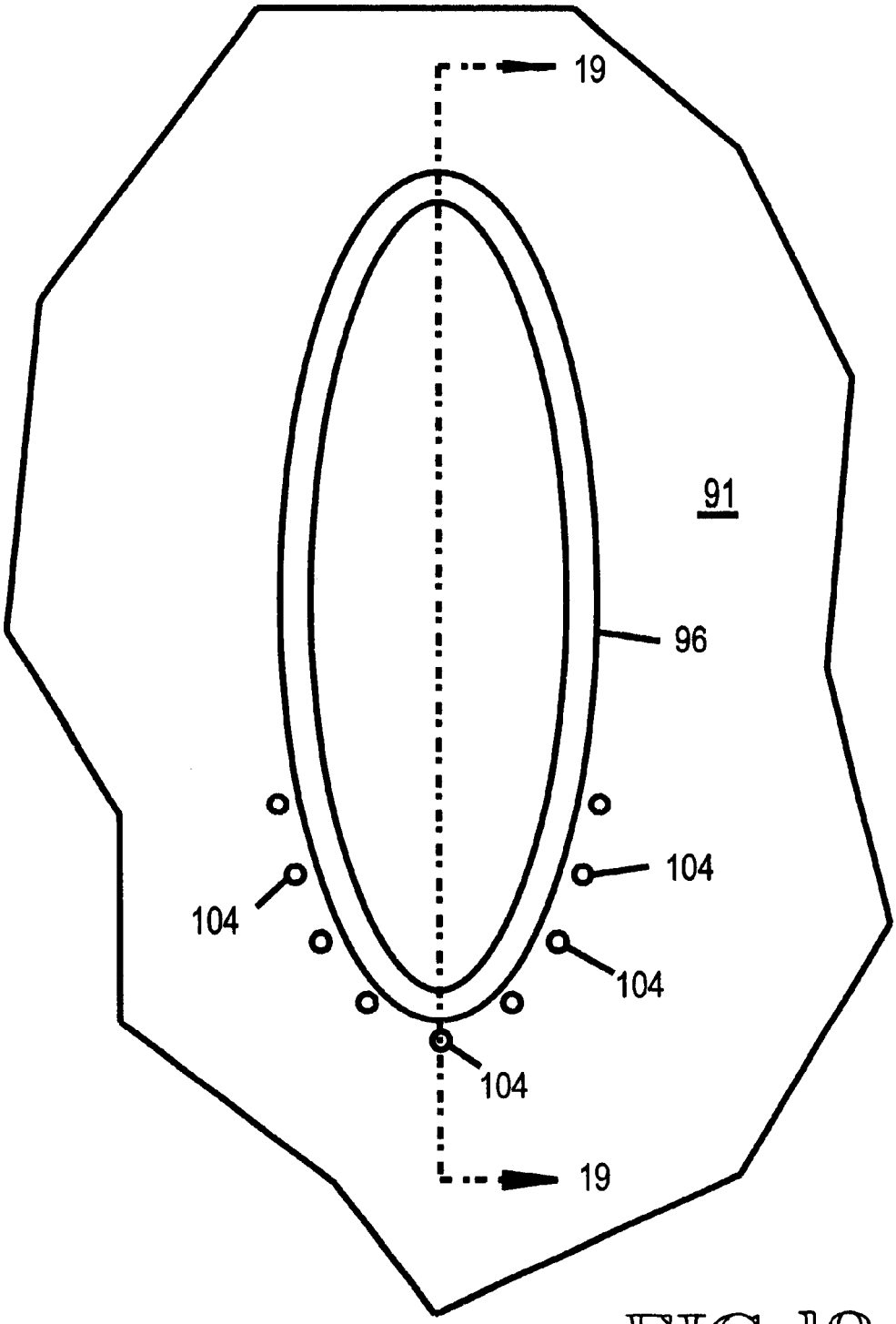
FIG. 18 is an end view of one heat absorber attached to the burner assembly of FIG. 17 illustrating another embodiment of the burner assembly which provides for a hydrogen boundary layer around each heat absorber.
Figure 19:
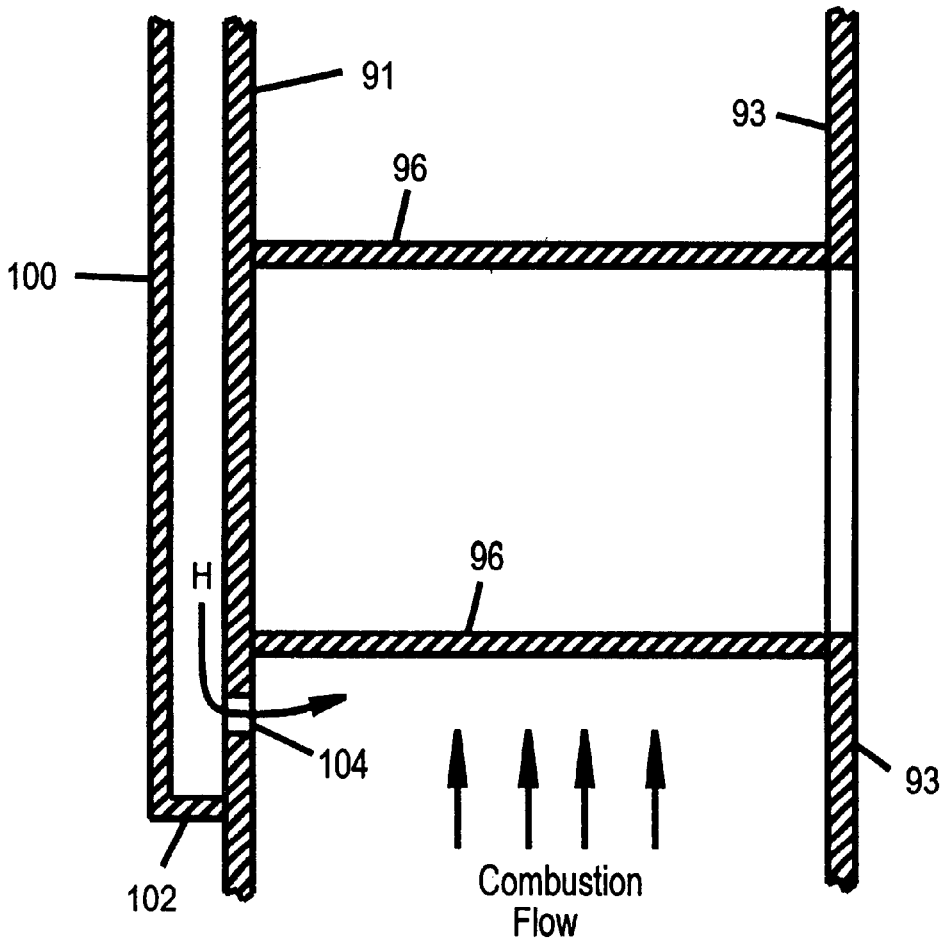
FIG. 19 is a cross-sectional view taken along line 19—19 of FIG. 18.

Heat transfer between the combustion gases and the heat absorbers 96 can be improved by surrounding the heat absorbers 96 with a boundary layer of hydrogen. Referring to FIGS. 18–19, in another embodiment of the continuous heat extraction burner, this is accomplished by making central air inlet 91 a double-wall structure to accommodate flow of hydrogen gas, and providing apertures through the central air inlet 91 to direct the hydrogen toward heat absorbers 96. The additional wall 100 is offset to the inside of central air inlet 91 by flange 102 on the lower end of wall 100 which seals the space between lower end of wall 100 and central air inlet 91 and provides for a uniform space between wall 100 and central air inlet 91. Flange 102 is vertically located below the bottom ring of heat absorbers 96. Air for the burner passes inside wall 100, and hydrogen passes between wall 100 and central air inlet 91.

A plurality of apertures 104 are provided through central air inlet 91 to direct hydrogen toward heat absorbers 96 as indicated by the arrow H. Apertures 104 are preferably located just below each heat absorber 96. One aperture 104 may be sufficient to allow hydrogen to flow from between wall 100 and central air inlet 91 to the lower end of heat absorber 96 where it naturally rises across the surface of heat absorber 96. Alternatively several apertures may be provided adjacent each heat absorber 96 following its contour at least part way up as illustrated in FIG. 18 to provide a more uniform flow of hydrogen across the heat absorber 96. The flow of combustion gases, as indicated by the arrows also helps direct the hydrogen exiting apertures 104 upward and onto the surface of heat absorber 96. Though some hydrogen will mix with the combustion flow and burn, significant hydrogen will adhere as a boundary layer to the surface of each heat absorber 96. The thermal conductivity of this boundary layer of hydrogen is significantly greater than a boundary layer formed by the combustion gases. The presence of the hydrogen boundary layer thereby increases the heat transfer between the combustion gases and the heat absorber 96.

Multi-Cylinder Dual Shell Configuration

Referring to FIG. 20, the dual shell Stirling engine of the present invention can be practiced in a multi-cylinder installation to drive a common electrical generator. The same principles used to connect multiple cylinders to a central crankshaft in internal combustion engines are applied here to achieve similar benefits of smoother operation and increased power. For Stirling engines, multi-cylinder use has an additional benefit of allowing cross coupling between cylinders which can eliminate the displacer piston. The technology for doing so is well known in the art.

FIG. 20 shows two complete engine assemblies joined at the lower housing 21. The configuration shown has the two salt shells 34 in-line and attaches the two crankshafts 17 together to form a common in-line crankshaft which joins to a common generator which is enclosed in a generator housing 150.

Alternative Embodiments

Regenerator Variations

The regenerator 6 could be fabricated as the annulus described or it could be made flat and cut into sheets. The individual sheets could be assembled as flat sheets with the fibers running approximately perpendicular to the fluid motion. Concentric cylinders could be used to form the annulus; again with the fibers running approximately perpendicular to the fluid motion. The only critical item for the graphite regenerator is the use of slotted channels for fluid flow and heat transfer. The fiber materials could be carbon, graphite, Boron Carbide, Boron Nitride, or Silicon Carbide or a number of metals such as Tantalum, Molybdenum, or Tungsten. The matrix could be carbon, Boron, ceramic oxides, or Borides. The regenerator could be coated with various surfaces for heat transfer, corrosion protection, or erosion protection. An example of a surface coating would be a thin layer of Boron Carbide, or Boron Nitride, or Silicon Carbide. Other metals or ceramics could be used for the fibers or the matrix. Also a combination of fibers or matrix materials could be used. The regenerator sheets could be porous and tilted a few degrees to the flow so that the flow would have to cross the sheet surface boundaries; flowing through the surface could enhance heat transfer. Other materials with a thermal bias could be used such as graphite plate or other fiber mixes. The regenerator could also be multiple layers of a pure metal sheet.

Variations in Heat Transfer Region

The liquid metal reservoir could be made any shape and volume. The fluid could be any compatible liquid or semi-liquid material; such as a slush or paste. The bellows could be as shown or any shape which applied a pressure to the dome chamber region. The bellows could be two sheets of metal which are sealed on all three sides and attached through the wall of the cylinder. The dome could possibly have a pipe running to the top of the dome region from the top of the cylinder. Some means of preventing the liquid metal from spilling into the pipe, such as a filter, could also work to pressurize the dome. With the stresses on the heat transfer tubes reduced substantially the tubes could be made into flat tubes for increased heat transfer benefits. If the open tube technique was used for pressurizing then the heat transfer tubes could be slightly porous to the working fluid such as carbon tubing which could operate at higher temperatures.

The liquid metal region 4 could be filled with a number of metals, metal alloys or mixtures. These could include, but are not limited to, pure metals and mixtures of Sodium, Potassium, Lithium, Magnesium, Aluminum, Silver, or Copper.

Variations in Liquid Salt Containment System

The liquid salt region 33 could be mixed with a fiber material, such as silica or mullite fibers which prevent the liquid from moving in the salt shell 34. The liquid salt region 33 could also be mixed with a non-melting power, or a series of non-porous or semi-porous sheets.

The liquid salt could be a number of compounds and mixtures which provide an incompressible or semi-incompressible insulating environment. A potential salt mixture could be Silver Chloride and Lead Chloride. The liquid salt technique would be useful for a variety of engines and heat transfer devices which operate at high temperature and pressure. These could include Brayton, Rankin, or Stirling engines.

Variations for Dual Shell Arrangement

Heat transfer designs could be made which have multiple tubes surrounding each heat transfer tube 5. The first tube would be the heat transfer tube 5 which contains the working fluid. The second tube would be a high conductivity flowing liquid such as Sodium. The third tube would be a liquid salt tube. The liquid salt tube could be connected to a region around the dome 25 or the outer shell 24 to provide the time varying pressure field.

Heat Transfer Tubing Variations

The star channel 80 could have any number of grooves 85. The grooves 85 could be any shape or depth. The star channel 80 and star housing 81 could be made from a single piece of material. The star assembly 82 could also be cast as a unit with removable filler material in the groove 85 region. In that case the star assembly 82 could have a cross-sectional shape other than round, such as elliptical, square, rectangular, or other shape conducive to facilitating heat transfer. The star assembly 82 could also be kept straight eliminating the need for the mid integral collar 88. The diffuser region 86 could be any shape or taper, or it could be eliminated altogether. The star assembly 82 could be bent into any shape, angle, or pattern.

Continuous Heat Extraction Burner Variations

The burner could have any number or pattern of heat absorbers 96. The heat absorbers 96 can be any shape including elliptical, circular, or oval. The air and fuel intake tubes can be in-line with the heat absorbers with or without flow reversing region 94.

Multi-Cylinder Dual Shell configuration Variations

The multi-cylinder configuration could have any number of engine combinations attached at the lower housing. The junction between each housing could have a clutch to allow for the shutting down of various numbers of engines in series. The engines could be attached to either side of the generator or to both sides or with a gear box.

A multi-cylinder configuration could also have cross-ducting between cylinders thereby eliminating the displacer piston. Several cylinders could be contained within a larger dual shell or triple shell envelope.

System Variations

The dome could be heated directly using solar, flame, Nuclear, Radiation, or chemical heat transfer mechanisms. The heat pipes could stop at the dome surface and help spread the heat internally.

These system improvements would work equally well with multiple cylinder engines and with different Stirling cycles; such as the Rigina cycle where the flow moves to different cylinders during operation.

The pressure shell assembly could be surrounded with a vacuum shell to reduce heat losses. The cooling system could also be built as a finned system for heat dissipation. Spacers could be added between the outer flange and the cooling flange to reduce heat transfer at the junction.

The displacer piston 1 could have a small hole located near the bottom of the piston to maintain the local pressure inside the piston. The piston could also be filled with a fiber insulation.

The lower housing could operate with any number of power output systems.

A possible technique for lubricating the engine is to use a dry Hexagonal Boron Nitride powder. The powder could be allowed to circulate through the upper and lower chambers.

Conclusion

The dual shell Stirling engine offers significant improvements in efficiency, simplicity, system integration, and cost. The unique dual shell configuration allows higher operating temperatures with resultant efficiency benefits. The annular regenerator offers improved efficiency and power levels. The throttling system is integrated into a reliable, light weight package that maintains engine efficiency. The dual chamber shaft seal prevents the escape of primary working fluid significantly enhancing the practicality of the engine. The wobble plate provides a simple and efficient mechanism for controlling the displacer piston. The heat transfer tubing configuration reduces manufacturing cost and increases reliability. The continuous heat extraction burner reduces flame temperature and nitrous oxide emissions from the burner.

The individual elements in the patent can be used as a whole unit or as sub-assemblies on new or existing Stirling engine designs. Thus existing engines can benefit from the improvements.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims.

What is claimed is:

1. An insulating high temperature dual shell pressure chamber comprising:

an inner container adapted to contain a fluid which is operating in a time varying high temperature and pressure field; and an outer container which surrounds the inner container and is filled with an insulating liquid having low heat transfer properties;

whereby the dual shell provides an insulating pressure region which reduces the pressure forces on the inner container and allows the outer container to operate at a reduced temperature relative to the inner container.

2. The dual shell pressure chamber of claim 1, wherein the inner container has a thermally conductive liquid, occupying a portion of all of the volume thereof, the container surrounding a series of heat transfer elements operating in the time varying temperature and pressure field.

3. The dual shell pressure chamber of claim 2, wherein the inner container has an opening that allows communication between the thermally conductive liquid in the inner container and the insulating liquid in the outer container.

4. The dual shell pressure chamber of claim 3, wherein the opening of the inner container is formed by a cylindrical portion, and the outer container includes a tubular portion which extends into the cylindrical portion inner container thereby forming an annular region between the tubular portion and the cylindrical portion.

5. The dual shell pressure chamber of claim 4, wherein the thermally conductive liquid and the insulating liquid have an interface occurring in the annular region between the tubular portion and the cylindrical portion.

6. The dual shell pressure chamber of claim 1, wherein;

said fluid comprises a thermally conducting liquid; and further comprising a heat transfer element extending from the outside of the outer container through the inner container and into the thermally conducting liquid, the heat transfer element adapted to operate in the time varying temperature and pressure field.

7. In a Stirling engine having a cylinder in which a working fluid is contained, the cylinder having first and second expansion chambers separated by a movable displacement member, the cylinder having a power piston connected to a crankshaft having an end portion and a central portion substantially parallel to the end portion, the central portion supporting a pair of bearings through which the power piston is connected to the crankshaft, a device for controlling motion of the displacement member comprising:

a plate fixedly connected substantially normal to the central portion of the crankshaft and disposed between the pair of bearings, the plate having an outer edge; and a follower connected to the displacer member, the follower being driven by the outer edge of the plate to move the displacer member as the crankshaft rotates.

8. The device of claim 7, wherein the outer edge of the plate is circular and further comprising a bearing disposed around the outer edge of the plate and a cap disposed around the bearing, the follower being connected to the cap.

9. A wobble plate for moving a displacer member of a Stirling engine having a rotating crankshaft with a central portion substantially parallel to and offset from an end portion, the central portion being connected to a power piston, the wobble plate comprising:

a plate attached to the central portion of the crankshaft so that the central portion of the crankshaft is substantially normal to the plate, the plate having an outer edge; and an elongated follower having a first end connected to the displacer member and a second end associated with the outer edge of the plate;

whereby eccentric rotational motion of the plate causes translational motion of the follower and displacer member.

10. The wobble plate of claim 9 wherein the outer edge of the plate is circular and further comprising a bearing disposed around the outer edge of the plate and a cap disposed around the bearing, the second end of the follower being connected to the cap.

11. A Stirling engine comprising:

a cylinder in which a working fluid is contained, the cylinder comprising first and second expansion chambers separated by a movable displacer member, the first expansion chamber being connected to at least one heat exchange conduit adapted for moving the working fluid between the expansion chambers, the second expansion chamber being connected to at least one cooling conduit adapted for moving the working fluid between the expansion chambers;

a cooling vessel for surrounding the at least one cooling conduit with a cooling medium;

a regenerator connected between the conduits providing movement of the working fluid therebetween, whereby heat loss from the heat exchange conduit to the cooling conduit as the working fluid travels from one to the other is minimized;

a crankshaft which is rotationally driven as a result of movement of and a pressure change in the working fluid;

a plate attached to the crankshaft for driving the displacer member; and a follower having a first end connected to the displacer member and a second end associated with the plate such that the second and tracks the plate as the plate rotates.

12. The engine of claim 11, wherein the plate is circular and further comprising a bearing located around the outer edge of the plate and a cap located around the bearing, the second end of the follower being connected to the cap.

13. The engine of claim 12, wherein the plate is comprised of two mating circular portions, and each portion has an outer flange which contains the bearing when the portions are assembled.

14. The engine of claim 12, wherein the cap has an eyelet and the second end of the follower attaches to the eyelet.

15. A Stirling engine comprising:

a cylinder in which a working fluid is contained, the cylinder comprising first and second expansion chambers separated by a movable displacer member, the first expansion chamber being connected to a plurality of tubular unshaped heat exchange conduits adapted for moving the working fluid between the expansion chambers, the second expansion chamber being connected to a plurality of cooling conduits adapted for moving the working fluid between the expansion chambers;

a dual shell pressure chamber including an inner container which is adapted to contain a fluid at high temperature and pressure surrounding the heat exchange conduits and an outer container surrounding the inner container and filled with a substantially incompressible thermal insulating liquid;

a cooling vessel for surrounding the cooling conduits with a cooling medium;

a regenerator connected between the heating and cooling conduits providing movement of the working fluid therebetween, whereby heat loss from the heat exchange conduits to the cooling conduits as the working fluid travels from one to the other is minimized; and mechanical means in the second expansion chamber which is driven as a result of movement of and a pressure change in the working fluid.

16. The engine of claim 15, wherein the heat exchange conduits are arranged in a circular array.

17. The engine of claim 15, wherein the heat exchange conduits include a tubular element and a star channel element disposed inside the tubular element, the star channel element being an elongated body having an external surface with a plurality of longitudinal grooves, the grooves being adjacent the tubular element.

18. The engine of claim 17, wherein the star channel element has a tapered point on at least one end, the tapered point being disposed inside the tubular element.

19. The engine of claim 17, wherein the heat exchange conduit has a generally round cross section.

20. The engine of claim 15, wherein the cylinder, dual shell pressure chamber, cooling vessel, regenerator and mechanical means comprise a sub assembly connected to a crankshaft, and a plurality of sub assemblies are connected to the crankshaft.

21. In a Stirling engine having heat exchange conduits arranged in an annular array and a container which is adapted to contain a fluid at high temperature and pressure surrounding the heat exchange conduits, a device for applying heat to the fluid, comprising:

a heater tube having a closed end extending into the container amidst the heat exchange conduits;

a burner shell disposed inside of the heater tube, the burner shell including a tube with a closed end, so that an annular space exists between the burner shell and the heater tube, the burner shell having a plurality of apertures communicating with the annular space;

an air inlet tube coaxially positioned inside the burner shell, the air inlet tube having an end proximate the closed end of the burner shell;

a fuel inlet tube disposed inside the air inlet tube; and a plurality of heat absorbers, each heat absorber including a tubular element extending generally radially from the air inlet tube to the burner shell at an aperture, the tubular element having an internal space, the aperture providing fluid communication between the internal space and the annular space between the burner shell and the heater tube.

22. The device of claim 21, wherein the fuel inlet tube has an outlet end positionally adjustable longitudinally relative to the end of the air inlet tube.

23. The device of claim 21, wherein the internal space of the tubular elements and the annular space between the burner shell and heater tube contain silver.

24. The device of claim 21, wherein the tubular elements are elliptically shaped.

25. The device of claim 21, wherein the heat absorbers are arranged so as to form rings of radially oriented tubular elements disposed about the air inlet tube near its end, and the rings are longitudinally spaced and clocked on the air inlet tube so that tubular elements of a ring are approximately centered about gaps between tubular elements of an adjacent ring.

26. The device of claim 25, wherein the closed end of the burner shell is hemispherical.

27. The device of claim 21, further comprising a hydrogen supply tube coaxially disposed between the fuel inlet tube and air inlet tube, and at least one aperture through the air inlet tube adjacent and below each heat absorber, the at least one aperture providing fluid communication between a space between the air inlet tube and the hydrogen supply tube and a space outside of the air inlet tube adjacent a heat absorber.

28. A heat exchange conduit comprising:

an elongated body having an outer surface and a plurality of internal longitudinal tubes through which a fluid flows, the tubes being all disposed inside of and adjacent the outer surface whereby heat is transferred between the outer surface and the material flowing in the tubes.

29. A burner for use with a Stirling engine, comprising:

an air inlet tube having an outlet end;

a fuel inlet tube disposed within the air inlet tube;

a burner shell tube outside of and coaxial with the air inlet tube and having a closed end proximate the outlet end of the air inlet tube;

a plurality of heat transfer elements attached to and extending generally radially between the burner shell tube and the air inlet tube near its outlet end;

the burner shell having a plurality of apertures aligning with the heat transfer elements to allow fluid communication between an inner region of the heat transfer elements and an area outside of burner shell.

30. A dual chamber system for minimizing gas losses through seals around a shaft, comprising:

an inner housing defining an inner chamber containing a quantity of working gas;

an outer housing defining an outer chamber outside of and adjacent the inner housing, the outer chamber containing a quantity of gas;

a shaft extending through the inner housing and outer housing;

a first seal between the shaft and the inner housing;

a second seal between the shaft and the outer housing;

the inner chamber being pressurized to a level and the outer chamber being pressurized to a level near that of the inner chamber to minimize the movement of the working gas across the first seal.

31. The conduit of claim 28, wherein the body has a generally round cross section.

32. The conduit of claim 31 wherein the outer surface is formed by a tubular element and further comprising a star channel element disposed inside the tubular element, the star channel element being an elongated body having an external surface with a plurality of longitudinal grooves, the grooves being adjacent the tubular element to form the longitudinal tubes.

33. The conduit of claim 32, wherein the star channel element has a conical point on at least one end, the conical point being disposed inside the tubular element.

34. The conduit of claim 32, wherein the tubular element has a wall having at least one thicker portion, the thicker portion providing additional material to allow for wall thinning during bending of the conduit.

35. The conduit of claim 34, wherein the conduit is bent to a U-shape.

36. The conduit of claim 32, wherein the tubular element and the star channel have a fused interface.

* * * * *

UNITED STATES PATENT AND TRADEMARK OFFICE

CERTIFICATE OF CORRECTION

PATENT NO. : 6,263,671 B1
DATED : July 24, 2001
INVENTOR(S) : Wayne T. Bliesner

It is certified that error appears in the above-identified patent and that said Letters Patent is hereby corrected as shown below:

Column 11,
Line 12, insert -- or tubes -- after "passages".

Signed and Sealed this

Sixteenth Day of April, 2002

*Attest:*

*Attesting Officer*

JAMES E. ROGAN
*Director of the United States Patent and Trademark Office*